US005657391A

United States Patent [19]

Jyosako

[11] Patent Number: 5,657,391

[45] Date of Patent: Aug. 12, 1997

[54] SOUND IMAGE ENHANCEMENT APPARATUS

[75] Inventor: Katsunori Jyosako, Higashihiroshima, Japan

[73] Assignee: Sharp Kabushiki Kaisha, Osaka, Japan

[21] Appl. No.: 471,455

[22] Filed: Jun. 6, 1995

[30] Foreign Application Priority Data

Aug. 24, 1994 [JP] Japan ..... 6-199425
Mar. 31, 1995 [JP] Japan ..... 7-076773

[51] Int. Cl.[6] ..... H04R 5/00

[52] U.S. Cl. ..... 381/1; 381/63

[58] Field of Search ..... 381/1, 17, 18, 381/63, 19, 27, 2

[56] References Cited

U.S. PATENT DOCUMENTS 5,067,157 11/1991 Ishida et al. ..... 381/1
5,119,420 6/1992 Kato et al. ..... 381/1
5,121,433 6/1992 Kendall et al. ..... 381/1
5,305,386 4/1994 Yamato ..... 381/1

FOREIGN PATENT DOCUMENTS 58-830299 2/1983 Japan .

*Primary Examiner*—Curtis Kuntz
*Assistant Examiner*—Vivian Chang

[57] ABSTRACT

A sound image enhancement apparatus for reproducing two-channel stereo signals with speakers, includes for each channel a first phase shifter and a second phase shifter for introducing different amounts of phase shift to the signals. These phase shifters may be connected in parallel or in series. This arrangement enables virtual speakers to be located at the back of a listener. An inexpensive DSP is usable, and the number of processing steps is reduced to about one third of the number when an FIR filter is used. Moreover, it is possible to reproduce reverberation sounds from the front, back and sides, thereby simulating sound fields at a live performance.

3 Claims, 20 Drawing Sheets

SOUND IMAGE ENHANCEMENT APPARATUS

FIELD OF THE INVENTION

The present invention relates to a sound image enhancement apparatus suitable for use in acoustic devices and video devices for performing stereophonic sound reproduction.

BACKGROUND OF THE INVENTION

In a conventional acoustic device for performing stereophonic sound reproduction, if left and right speakers are disposed without sufficient space therebetween, dimensional sound cannot be perceived. In order to produce dimensional sound, a difference signal (L–R) is extracted from left and right channel sound signals L and R. Then, a signal whose level and phase are controlled is added to the left channel sound signal L, while a signal of opposite phase relative to the signal having the controlled level and phase is added to the right channel sound signal R.

For example, a sound image enhancement circuit 1' has a structure shown in FIG. 23. In this structure, the left channel sound signal L and the right channel sound signal R are input to left and right channel input terminals 2L and 2R, respectively. The left channel sound signal L is sent to an adder 6L, while a signal of opposite phase relative to the left channel sound signal L is output to an adder 3. Similarly, the right channel sound signal R is sent to the adder 3 and an adder 6R.

In the adder 3, after a difference signal (L–R) is generated based on the input left and right channel sound signal L and R, the level of the difference signal (L–R) is attenuated by a predetermined amount by an attenuator 4 with an attenuation coefficient A. Then, a signal [(L–R)·A] is sent to a phase shifter 5.

In the phase shifter 5, the phase of the input signal [(L–R)·A] is shifted by Φ, and a signal [(L–R)·A]∠Φ (where ∠ represents the phase) is sent to the adder 6L. At this time, a signal -[(L–R)·A]∠Φ of opposite phase relative to the input signal [(L–R)·A]∠Φ is sent to the adder 6R. In the adder 6L, an output of the phase shifter 5 and the left channel sound signal L are added, and a signal [L+((L–R)·A)∠Φ] is output as a reproduced sound output from an output terminal 7L. Similarly, in the adder 6R, a signal of opposite phase relative to the output of the phase shifter 5 and the right channel sound signal R are added, and the resulting signal [R–((L–R)·A)∠Φ] is output as a reproduced sound output from an output terminal 7R.

In order to simplify the explanation, assume that the right channel sound signal R is zero. Then, a signal [L(1+A∠Φ)] is output as a reproduced sound output from the output terminal 7L, while a signal (–LA∠Φ) is output as a reproduced sound signal from the output terminal 7R. This is explained by a vector diagram shown in FIG. 24. For the sake of convenience, the vectors of the reproduced sound outputs from the output terminals 7L and 7R are indicated as 7L and 7R, respectively, in FIG. 24.

When the vectors 7L and 7R are combined, a virtual speaker 10L' is located on a line connecting speakers 10L and 10R along the direction of the synthetic vector as shown in FIG. 24.

Similarly, with respect to the right channel sound signal, assuming that the left channel sound signal L is zero, when the vectors 7L and 7R are combined, a virtual speaker 10R' is located on a line connecting the speakers 10L and 10R along the direction of the synthetic vector. Such a placement of the virtual speakers 10L' and 10R' is achieved by adjusting the attenuator 4 and the phase shifter 5.

As described above, the sound image enhancement circuit 1' performs analog processing using an analog circuit. However, it is also possible to obtain similar results by performing digital processing using a DSP (Digital Signal Processor).

A virtual sound source is generated on the basis of a transfer function. In this case, the transfer function is given according to the order of an FIR (Finite Impulse Response) filter, processed by the DSP. Referring now to FIG. 25, the following description discusses sound image enhancement on the basis of a transfer function.

How the virtual speaker 10L' is realized with the use of the two speakers 10L and 10R will be explained with reference to FIG. 25. The explanation is made by denoting the sound sources in the L channel and R channel as $S_L$ and $S_R$, respectively, the transfer function when sounds from the speakers 10L and 10R fall on each ear of a listener as $H_{AL}$, $H_{AR}$, $H_{BL}$ and $H_{BR}$, and the transfer function when a sound from the virtual speaker 10L' falls on the left ear of the listener as $H_R$ and $H_L$. In addition, assuming that only the L-channel sound source $S_L$ is present as the sound signal ($S_R$=0), signals input to the speakers 10L and 10R are L and R, respectively, the level of sound pressure when sounds from the speakers 10L and 10R fall on the left ear is $E_L$ and that the level of sound pressure when the sounds fall on the right ear is $E_R$, the following equations are established.

$$E_L=L\cdot H_{AL}+R\cdot H_{BL} \quad (1)$$

$$E_R=L\cdot H_{AR}+R\cdot H_{BR} \quad (2)$$

Moreover, assuming that the level of sound pressure when a sound from the virtual speaker 10L' falls on the left ear is $E_L'$ and that the level of sound pressure when the sound falls on the right ear is $E_R'$, the sound pressure is given:

$$E_L'=S_L\cdot H_L \quad (3)$$

$$E_R'=S_L\cdot H_R \quad (4)$$

In this case, in order to achieve a virtual speaker based on the sounds from the speakers 10L and 10R, it is necessary to satisfy the following equations at the positions of the ears of the listener.

$$E_L'=E_L \text{ and } E_R'=E_R$$

Next, when the listener is equidistant from the speakers 10L and 10R, the transfer functions from the speakers 10L and 10R become symmetrical between left and right with respect to the position of the listener. Since the equations $H_{AL}=H_{BR}$ and $H_{AR}=H_{BL}$ are established, the signals L and R input to the speakers 10L and 10R are given:

$$R=S_L\cdot(H_L\cdot H_{AR}-H_R\cdot H_{AL})/(H_{AR}\cdot H_{AR}-H_{AL}\cdot H_{AL}) \quad (5)$$

$$L=S_L\cdot(H_L\cdot H_{AL}-H_R\cdot H_{AR})/(H_{AR}\cdot H_{AR}-H_{AL}\cdot H_{AL}) \quad (6)$$

Suppose that $$H0=(H_L\cdot H_{AR}-H_R\cdot H_{AL})/(H_{AR}\cdot H_{AR}-H_{AL}\cdot H_{AL})$$

$$H1=(H_L\cdot H_{AL}-H_R\cdot H_{AR})/(H_{AR}\cdot H_{AR}-H_{AL}\cdot H_{AL}),$$

equations (5) and (6) above are written:

$$R=S_L\cdot H0 \quad (7)$$

$$L=S_L\cdot H1 \quad (8)$$

By outputting the signals L and R represented by the above-mentioned transfer functions from the speakers 10L and 10R, the virtual speaker 10L' is realized.

The transfer functions are actually given by obtaining the order of (the number of steps in) the FIR filter using, for example, a window function with respect to the results of measurement at the positions of the speakers 10L and 10R and the position of the virtual speaker 10L'. The order of the FIR filer is usually obtained as follows. Suppose that the order is N, the sampling frequency is $f_s$, an attenuation band is $\Delta f$, and the coefficient is D (where D is between 0.9 and 1.3), $$N=[[(f_s/\Delta f)\cdot D+1]]$$

where [[x]] is a minimum odd integer larger than x.

For example, if $f_s$=48 kHz, $\Delta f$=200 Hz, and D=1, the order N becomes 243. However, in general, since the window function is used, the order is decreased and the order of the FIR filter is sufficiently utilized with 128 steps. For the convolutional operation of the FIR filter, since the operation is carried out twice for each channel, an operation including more than 128×2=256 steps in total is required. By changing the coefficient of the convolutional operation of the FIR filter, the virtual speaker is placed in a desired position. The structure according to the above explanation is shown in FIG. 26. An FIR filter 35L corresponds to equation (7), and an FIR filter 36L corresponds to equation (8). FIR filters 35R and 36R correspond to the case where only the R-channel sound signal R is present as a sound signal ($S_L$=0), and a detailed explanation thereof will be omitted here.

In a conventional art, in order to simulating the perception of a sound field at a live performance (in order to obtain a sound field simulation of Concert Hall, Nightclub, or Stadium), reverberation signals are generated based on input sound signals using a delay circuit, added to the input sound signals, and then reproduced by two front speakers. In order to more faithfully simulate the perception of the live performance, two rear speakers may be provided at the back in addition to the two front speakers so that the reverberation signals are reproduced by the rear speakers.

However, with this conventional art using a phase shifter, the sound sources only spread on a line connecting the left and right speakers. Since a sound image can not spread to the back of the listener, the conventional art fails to simulate the perception of a live performance.

Moreover, high frequency sounds do not spread, and thus the resulting sounds have a rather monaural sound quality. Therefore, with the conventional art, it is necessary to provide additional speakers at the back of the listener in order to more faithfully simulate the perception of a live performance.

Furthermore, when performing digital processing using a DSP, virtual speakers are located in desired positions by reproducing the resulting outputs of the FIR filter. Namely, it is possible to provide the virtual speakers at the back of the listener and to satisfactorily simulate the perception of a live performance. However, as described above, in order to perform the operation of 256 steps for each channel by the DSP, it is necessary to use a plurality of extremely high-speed DSPs. However, since such an extremely high-speed DSP is fairly expensive, the cost of the apparatus on the whole becomes very expensive.

In addition, with a conventional art related to simulating the perception of a live performance, although the effect of reverberation sounds is produced by providing only two speakers at the front, a satisfactory perception of a live performance can hardly be simulated. If four speakers are installed at the front and back, it is necessary to determine the installation positions of the rear speakers with precision. Besides, since the two rear speakers are additionally provided, the structure of the apparatus becomes complicated. Consequently, such an apparatus has not widespread among the ordinary families.

SUMMARY OF THE INVENTION

An object of the present invention is to provide an inexpensive sound enhancement apparatus capable of spreading a sound image to the back of a listener and simulating the perception of a live performance.

In order to achieve the above object, a first sound image enhancement apparatus of the present invention is based on a sound image enhancement apparatus for reproducing two-channel stereo signals with speakers, and includes the following means for each channel.

Specifically, each channel of the first sound image enhancement apparatus includes: additional signal generating means for subtracting from a stereo input signal of one of the two channels a stereo input signal of the other channel which has been attenuated by a first attenuation coefficient, and outputting the resulting signal as an additional signal; first phase shifting means for attenuating the additional signal by a second attenuation coefficient, and introducing a predetermined phase shift to the attenuated signal; second phase shifting means for attenuating the additional signal by a third attenuation coefficient, correcting a frequency characteristic thereof, and introducing a predetermined phase shift to the resulting signal; first summing means for inverting a phase of an output of the first phase shifting means, and adding the inverted output to the stereo input signal of the other channel; and second summing means for inverting a phase of an output of the second phase shifting means, adding the inverted output to an output of the first summing means, and sending the resulting sum to the speaker of the other channel.

With this structure, a stereo signal of each channel is independently reproduced through the speaker as follows.

Namely, the additional signal generated by the additional signal generating means is attenuated by the second attenuation coefficient, and then phase-shifted by a predetermined amount by the first phase shifting means. Simultaneously, the additional signal is attenuated by the third attenuation coefficient, receives a frequency characteristic correction, and is then phase-shifted by a predetermined amount by the second phase shifting means.

The phase of the output of the first phase shifting means is inverted, and the inverted signal is sent to the first summing means. The first summing means adds up the inverted output and the stereo input signal of the other channel. On the other hand, the phase of the output of the second phase shifting means is inverted, and the inverted output is sent to the second summing means. The second summing means adds up the inverted output and the output of the first summing means.

The above-discussed processing is also performed for the other channel. Hence, the above-mentioned structure accurately orients virtual speakers at the back of the listener by adjusting the amounts of phase shift of the first and second phase shifting means as well as the respective attenuation coefficients.

In order to achieve the above object, a second sound image enhancement apparatus of the present invention includes second summing means for inverting the phase of the output of the second phase shifting means and adding the inverted output to the output of the first summing means, in place of the second summing means of the first sound image enhancement apparatus, and further includes:

delaying and attenuating means for delaying the output of the second phase shifting means of the other channel, and attenuating the delayed output by a fourth attenuation coefficient; and third summing means for adding up the output of the delaying and attenuating means and the output of the second summing means, and sending the resulting sum to the speaker of the other channel.

With this structure, the output of the second phase shifting means of the other channel is delayed and attenuated by the fourth attenuation coefficient by the delaying and attenuating means, and sent to the third summing means. The third summing means adds up the output of the delaying and attenuating means and the output of the second summing means, and sends the resulting sum to the speaker of the other channel.

Since the delaying and attenuating means forms a type of a comb filter, frequency components in the stereo input signal are attenuated or emphasized according to the amounts of delay. It is therefore possible to widen the low and mid frequency band sounds and to correct the signal level of high frequency band.

In order to achieve the above object, a third sound image enhancement apparatus of the present invention is based on the first or second sound image enhancement apparatus, wherein the first phase shifting means includes: a plurality of band-pass means, provided for each of predetermined frequency bands, for transmitting only input signals within the predetermined frequency bands; delaying means for introducing a predetermined phase delay to an output of each of the band-pass means; and fourth summing means for adding up outputs of the delaying means, and wherein the second phase shifting means includes an IIR-type digital low-pass filter.

With this structure, in the first phase shifting means, signals passed the respective band-pass means are phase-delayed by predetermined amounts by the delaying means and sent to the fourth summing means. In the fourth summing means, the outputs of the all of the delaying means are added up. Moreover, the second phase shifting means is formed by an IIR-type digital low-pass filter. It is therefore possible to ensure widening of a sound image with a simplified structure. Additionally, since the number of processing steps is decreased, it is possible to orient virtual speakers at the back of the listener with an inexpensive DSP but without using a high-speed DSP.

In order to achieve the above object, a fourth sound image enhancement apparatus of the present invention is a sound image enhancement apparatus for reproducing two-channel stereo signals with speakers, and includes the following means for each channel.

Namely the fourth sound image enhancement apparatus includes: additional signal generating means for subtracting from a stereo input signal of one of the two channels a stereo input signal of the other channel which has been attenuated by a first attenuation coefficient, and outputting the resulting signal as an additional signal; first phase shifting means for attenuating the additional signal by a second attenuation coefficient, and introducing a predetermined phase shift to the attenuated signal; second phase shifting means for attenuating the additional signal by a third attenuation coefficient, correcting a frequency characteristic thereof, and introducing a predetermined phase shift to the resulting signal; first summing means for inverting a phase of an output of the first phase shifting means, and adding the inverted output to the stereo input signal of the other channel; second summing means for inverting a phase of an output of the second phase shifting means, and adding the inverted output to an output of the first summing means; fourth summing means for adding up the additional signal and an additional signal of the other channel; fifth summing means for adding up an output of the fourth summing means and an output of the second phase shifting means of the other channel; delaying and attenuating means for delaying an output of the fifth summing means, and attenuating the delayed output by a fourth attenuation coefficient; and third summing means for adding up an output of the delaying and attenuating means and an output of the second summing means, and sending the resulting sum to the speaker of the other channel.

With this structure, the phases of the additional signals of both of the channels are shifted by the same second phase shifting means. After the output of the second phase shifting means is added to the additional signals of both of the channels, the resulting signal is delayed and attenuated by the delaying and attenuating means. It is thus possible to surely prevent the phase shift from causing a decrease of the output in transmission from the third summing means to the speaker.

In order to achieve the above object, a fifth sound image enhancement apparatus of the present invention is a sound image enhancement apparatus for reproducing two-channel stereo signals with speakers, and includes the following means for each channel.

Namely the fifth sound image enhancement apparatus includes: additional signal generating means for subtracting from a stereo input signal of one of the two channels a stereo input signal of the other channel which has been attenuated by a first attenuation coefficient, and outputting the resulting signal as an additional signal; first phase shifting means for attenuating the additional signal by a second attenuation coefficient, and introducing a predetermined phase shift to the attenuated signal; first summing means for attenuating the additional signal by a third attenuation coefficient, and adding up the attenuated signal and an output of the first phase shifting means; second phase shifting means for correcting a frequency characteristic of an output of the first summing means, and introducing a predetermined phase shift to the resulting signal; second summing means for inverting a phase of an output of the second phase shifting means, and adding the inverted output to the stereo input signal of the other channel; delaying and attenuating means for delaying an output of the second phase shifting means of the other channel, and attenuating the delayed output by a fourth attenuation coefficient; and third summing means for adding up an output of the delaying and attenuating means and an output of the second summing means, and sending the resulting sum to the speaker of the other channel.

With this structure, the additional signal is attenuated by the second attenuation coefficient, and then phase-shifted by a predetermined amount by the first phase shifting means. Thereafter, the additional signal is attenuated by the third attenuation coefficient, and sent to the first summing means. Then, the attenuated output and the output of the first phase shifting means are added up by the first summing means.

After correcting the frequency characteristic of the output of the first summing means, the phase of the resulting output is shifted by a predetermined amount by the second phase shifting means. The phase of the output of the second phase shifting means is inverted, and the inverted output is sent to the second summing means. In the second summing means, the inverted output is added to the stereo input signal of the other channel.

The output of the delaying and attenuating means and the output of the second summing means are added up by the third summing means, and sent to the speaker of the other channel.

As described above, since the first phase shifting means and the second phase shifting means are cascaded, the amount of phase shift becomes larger compared with the case where the first phase shifting means and the second phase shifting means are performed in parallel. As a result, the variable range of the locations of the virtual speakers is widened.

In order to achieve the above object, a sixth sound image enhancement apparatus of the present invention is based on the first sound image enhancement apparatus, and includes: additional signal generating means for subtracting from a second reverberation sound signal of one of the two channels a second reverberation sound signal of the other channel which has been attenuated by a first attenuation coefficient, and outputting the resulting signal as an additional signal; first summing means for inverting a phase of an output of the first phase shifting means, and adding the inverted output to the second reverberation sound signal of the other channel; and second summing means for inverting a phase of an output of the second phase shifting means, and adding the inverted output to an output of the first summing means, in place of the additional signal generating means, the first summing means and the second summing of the first sound image enhancement apparatus, respectively, and further includes: reverberation sound signal generating means for generating, for each channel, a first reverberation sound signal to be reproduced by the speaker in one channel and a second reverberation sound signal to be reproduced by a virtual rear speaker of the speaker, based on stereo input signals: sixth summing means for adding up the stereo input signal of the one channel and the first reverberation sound signal; and seventh summing means for adding up an output of the second summing means of the other channel and an output of the sixth summing means, and sending the resulting sum to the speaker of the other channel, the sixth summing means and the seventh summing means being provided for each channel.

With this structure, the first reverberation sound signal generated based on the stereo input signal is reproduced as a reverberation sound by the speaker. On the other hand, the second reverberation sound signal generated based on the stereo input signal is subjected to sound image enhancement processing, and then reproduced as a reverberation sound by the virtual speaker.

As described above, since two different types of reverberation sounds are reproduced by the speaker and the virtual speaker, respectively, it is possible to reproduce reverberation sounds from the front, back and sides of the listener depending on the combined state of the two types of reverberation sounds, thereby simulating a sound field at a live performance.

In order to achieve the above object, a seventh sound image enhancement apparatus of the present invention is based on the first or second sound image enhancement apparatus, and includes: additional signal generating means for subtracting from a second reverberation sound signal of one of the two channels a second reverberation sound signal of the other channel which has been attenuated by a first attenuation coefficient, and outputting the resulting signal as an additional signal; first summing means for inverting a phase of an output of the first phase shifting means, and adding the inverted output to the second reverberation sound signal of the other channel; and third summing means for adding up an output of the delaying and attenuating means and an output of the second summing means, in place of the additional signal generating means, the first summing means and the third summing means of the first or second image sound enhancement apparatus, and further includes: reverberation sound signal generating means for generating, for each channel, the first reverberation sound signal to be reproduced by the speaker in one channel and the second reverberation sound signal to be reproduced by a virtual rear speaker of the speaker, based on stereo input signals; sixth summing means for adding up the stereo input signal of the one channel and the first reverberation sound signal; and seventh summing means for adding up an output of the third summing means of the other channel and an output of the sixth summing means, and sending the resulting sum to the speaker of the other channel, the sixth summing means and the seventh summing means being provided for each channel.

With this structure, the first reverberation sound signal generated based on the stereo input signal is reproduced as a reverberation sound by the speaker. On the other hand, the second reverberation sound signal generated based on the stereo input signal is subjected to sound image enhancement processing and then reproduced as a reverberation sound by the virtual speaker.

As described above, since reverberation sounds of two different types are reproduced by the speaker and the virtual speaker, respectively, it is possible to reproduce reverberation sounds from the front, back and sides of the listener depending on the combined state of the two types of reverberation sounds, thereby simulating a sound field at a live performance.

In order to achieve the above object, an eighth sound image enhancement apparatus of the present invention is based on the fifth sound image enhancement apparatus, and includes: additional signal generating means for subtracting from a second reverberation sound signal of one of the two channels a second reverberation sound signal of the other channel which has been attenuated by a first attenuation coefficient, and outputting the resulting signal as an additional signal; second summing means for inverting a phase of an output of the second phase shifting means, and adding the inverted output to the second reverberation sound signal of the other channel; and third summing means for adding up an output of the delaying and attenuating means and an output of the second summing means, in place of the additional signal generating means, the second summing means and the third summing of the fifth sound image enhancement apparatus, and further includes: reverberation sound signal generating means for generating, for each channel, the first reverberation sound signal to be reproduced by the speaker in one channel and the second reverberation sound signal to be reproduced by a virtual rear speaker of the speaker, based on stereo input signals; sixth summing means for adding up the stereo input signal of the one channel and the first reverberation sound signal; and seventh summing means for adding up an output of the third summing means of the other channel and an output of the sixth summing means, and sending the resulting sum to the speaker of the other channel, the sixth summing means and the seventh summing means being provided for each channel.

With this structure, the first reverberation sound signal generated based on the stereo input signal is reproduced as a reverberation sound by the speaker. On the other hand, the second reverberation sound signal generated based on the stereo input signal is subjected to sound image enhancement processing, and then reproduced as a reverberation sound by the virtual speaker.

As described above, since reverberation sounds of two different types are reproduced by the speaker and the virtual speaker, respectively, it is possible to reproduce reverberation sounds from the front, back and sides of the listener depending on the combined state of the two types of reverberation sounds, thereby simulating a sound field at a live performance.

For a fuller understanding of the nature and advantages of the invention, reference should be made to the ensuing detailed description taken in conjunction with the accompanying drawings.

DESCRIPTION OF PREFERRED EMBODIMENTS

The following description discusses one embodiment of the present invention with reference to FIGS. 1 to 5.

Figure 2:
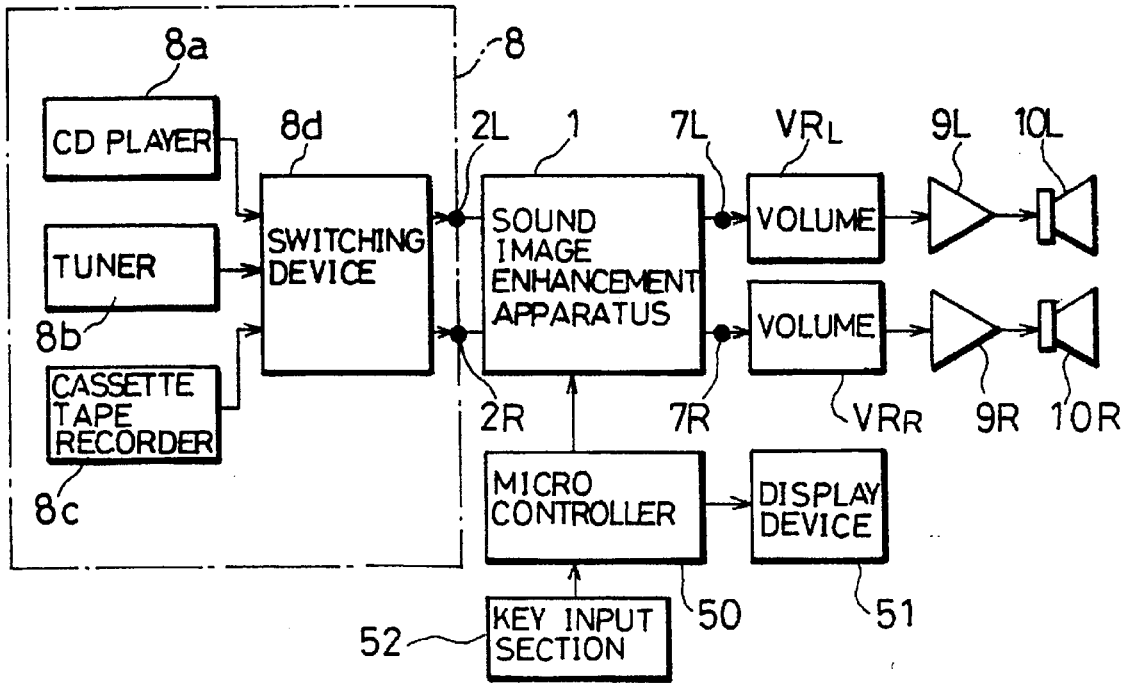
FIG. 2 is a block diagram showing the structure of the sound image enhancement apparatus of the present invention.

As illustrated in FIG. 2, two channels of stereo signals L and R are input to a sound image enhancement apparatus 1 of the present invention from a sound source 8 through a left channel input terminal 2L and a right channel input terminal 2R, respectively. The sound source 8 includes an input switching device **8*d*. The input switching device 8*d* is selectively switched to a CD (Compact Disk) player 8*a*, a tuner 8*b* and a cassette tape recorder 8*c***, and outputs a signal to be reproduced from one of these sound sources.

In the sound image enhancement device 1, a variety of processing for widening a sound image to the back of a listener using only two front speakers is performed on the basis of the input signals to be reproduced. The result is transmitted to the speakers 10L and 10R through output terminals 7L and 7R, volume controllers $VR_L$, $VR_R$ and amplifiers 9L and 9R, respectively. The sounds are reproduced through the speakers 10L and 10R.

A display device 51 and a key input section 52 are connected to the sound image enhancement apparatus 1 through a microcontroller 50. These devices are provided so as to switch a surround function between on and off and control the sound image. In the key input section 52, the surround function is switched between on and off using a predetermined key. Additionally, in the key input section 52, the angle of each virtual speaker and the dimensions of a sound image are varied using predetermined keys.

Figure 1:
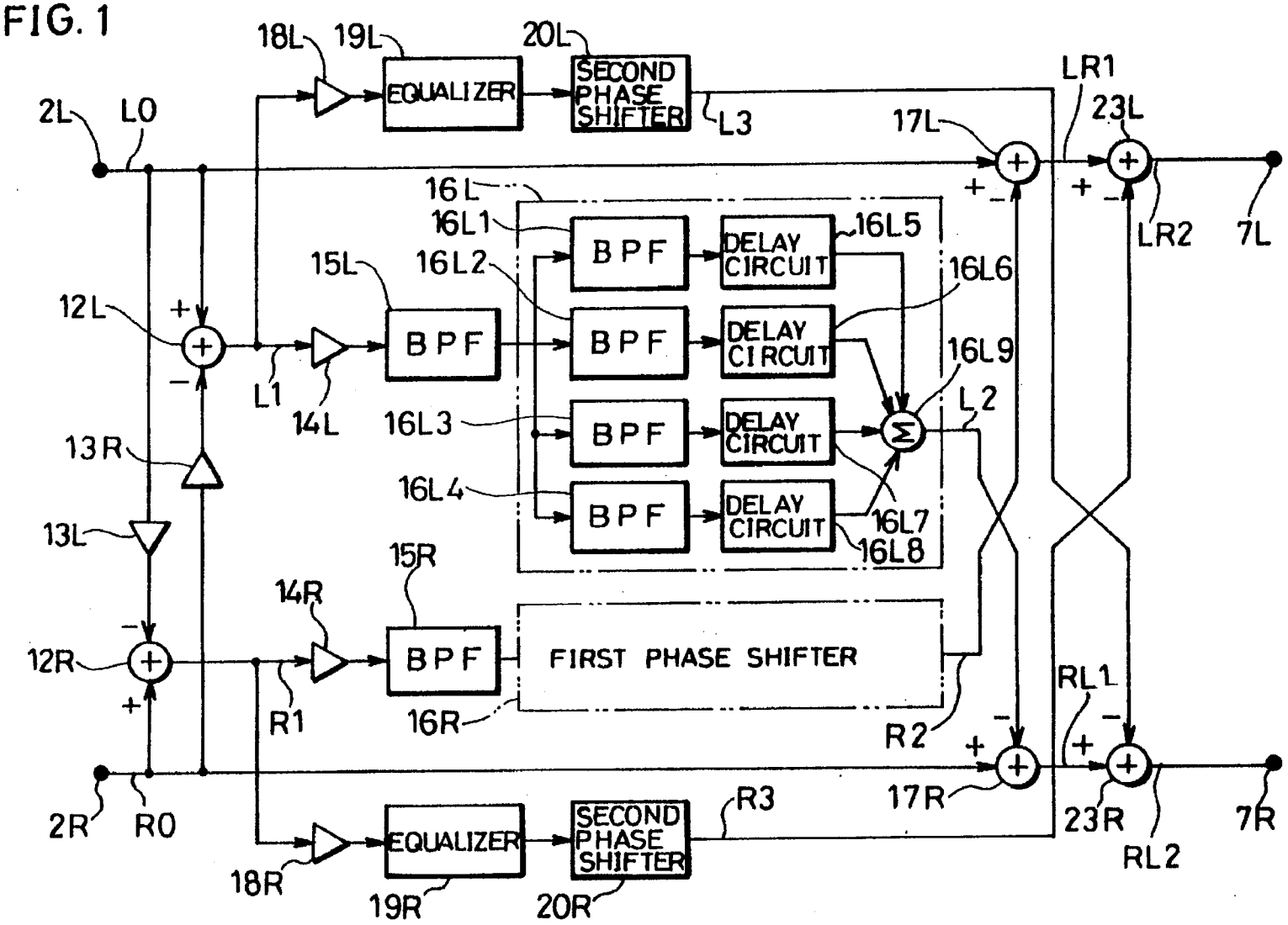
FIG. 1 is a block diagram showing an example of the structure of essential section of a sound image enhancement apparatus of the present invention.

For instance, when a "Surround" key is depressed at the time the surround function is switched off, the display device 51 displays "Surround ON", the attenuation coefficient of each of attenuators 14L and 14R (to be described later) shown in FIG. 1 is changed from, for example, 0 to 0.9, and the attenuation coefficient of each of attenuators 18L and 18R (to be described later) shown in FIG. 1 is changed from, for example, 0 to 0.6 under the control of the microcontroller 50. As a result, signals processed by a first phase shifter 16L (16R) and a second phase shifter 20L (20R) are added to the other channel, and reproduced through the speaker 10R (10L). Consequently, a virtual speaker is realized. The reference numerals in the brackets correspond to members in the other channel series.

For example, if a key related to the width of a sound image or the virtual speaker angle is selected, the selected setting is displayed by the display device 51, and an amount of phase shift of the second phase shifter 20L (20R) and the attenuation coefficient of the attenuator 18L (18R) are changed to pre-recorded values under the control of the microcontroller 50. It is thus possible to control the position of the virtual speaker from the front to back of the listener, realizing spaces of sound image desired by the listener.

Referring now to FIG. 1, the sound image enhancement apparatus 1 will be explained in detail below.

Regarding stereo input signals, suppose that signals of sound sources located on the left, right and front-center of the listener are $S_L$, $S_R$, $S_C$, respectively, a left channel sound signal to be input to the left channel of the sound image enhancement apparatus 1 is $L_0$, and a right channel sound signal to be input to the right channel is $R_0$, the following equation are given:

$$L_0=S_L+S_C$$

$$R_0=S_R+S_C$$

The following description will explain the flow of signals in the sound image enhancement apparatus 1 in detail. First, an explanation about the left channel will be given.

The right channel sound signal $R_0$ is transmitted to an attenuator 13R with an attenuation coefficient a (the first attenuation coefficient) where it is attenuated and its phase is inverted, and then sent to an adder 12L. In the adder 12L, the left channel sound signal $L_0$ is input, and the left channel sound signal $L_0$ and the right channel sound signal $R_0$ are added up and output as an additional signal L1.

$$L1=L_0-aR_0=(S_L+S_C)-a(S_R+S_C)=S_L-aS_R+(1-a)S_C \quad (9)$$

The additional signal L1 is sent through an attenuator 14L with an attenuation coefficient b (the second attenuation coefficient) to a band-pass filter (BPF) 15L so that only components within a frequency band requiring a phase control are sent to the first phase shifter 16L. The first phase shifter 16L is provided for controlling the phase so that the opposite phase components are reduced at the listener position.

The first phase shifter 16L includes four band-pass filters 16L1, 16L2, 16L3, 16L4, and delay circuits 16L5, 16L6, 16L7, 16L8 for introducing a delay in the transmission of the respective outputs of band-pass filters. The frequency band requiring a phase control is divided into four frequency bands by the band-pass filters 16L1, 16L2, 16L3, 16L4. The delay circuits 16L5, 16L6, 16L7, 16L6 introduce a predetermined delay in the transmission of signal in each frequency band so that the phase of each of the signals is shifted by ø11, ø12, ø13, and ø14, respectively. An amount of phase shift $\Phi_1$ in the first phase shifter 16L varies depending on the frequency. The outputs of the delay circuits 16L5, 16L6, 16L7, 16L8 are added up in an adder 16L9, and output as a signal L2. After the phase of the signal L2 is inverted, the resulting signal L2 is sent to an adder 17R. The signal L2 is expressed as:

$$L2=b\cdot L1\angle\Phi_1=b[S_L-aS_R+(1-a)S_C]\angle\Phi_1 \quad (10)$$

A signal RL1 expressed by the following equation is output by an adder 17R.

$$RL1=R_0L2=S_R+S_C-b[S_L-aS_R+(1-a)S_C]\angle\Phi_1 \quad (11)$$

The additional signal L1 is sent through the attenuator 18L with an attenuation coefficient c (the third attenuation coefficient) to an equalizer 19L where a low frequency band is emphasized, and then transmitted to the second phase shifter 20L. The second phase shifter 20L includes a simple IIR-type digital low-pass filter. An output signal L3 of the second phase shifter 20L is expressed as:

$$L3=c\cdot L1\angle\Phi_2=c\cdot(S_L-aS_R+(1-a)S_C)\angle\Phi_2 \quad (12)$$

A signal (−L3) is produced by inverting the phase of L3, and transmitted to an adder 23R. $\Phi_2$ in equation (12) represents an amount of phase shift provided by the second phase shifter 20L.

The signal (−L3) and the signal RL1 are added up in the adder 23R, and a signal RL2 is output. The signal RL2 is expressed by the following equation, and output to the output terminal 7R.

$$\begin{aligned} RL2 &= RL1-L3 \\ &= S_R+S_C-b[S_L-aS_R+(1-a)S_C]\angle\Phi_1- \\ &\quad c\cdot(S_L-aS_R+(1-a)S_C)\angle\Phi_2 \end{aligned} \quad (13)$$

A signal R3 is given as follows.

The left channel sound signal $L_0$ is sent to an attenuator 13L with the attenuation coefficient a where it is attenuated and its phase is inverted, and transmitted to the adder 12R. A right channel sound signal $R_0$ is input to the adder 12R. In the adder 12R, the right channel sound signal $R_0$ and the left channel sound signal $L_0$ are added up, and output as an additional signal R1.

$$R1=R_0aL_0=S_R-aS_L+(1-a)S_C \quad (14)$$

The additional signal R1 is sent through the attenuator 18R with the attenuation coefficient c to an equalizer 19R where low frequency bands are emphasized, and then transmitted to the second phase shifter 20R. The second phase shifter 20R includes a simple low-pass filter. An output signal R3 of the second phase shifter 20R is expressed as:

$$R3=c\cdot R1\angle\Phi_2=c\cdot(S_R-aS_L+(1-a)S_C)\angle\Phi_2 \quad (15)$$

Next, the flow of signals in the right channel of the sound image enhancement apparatus 1 is explained.

The additional signal R1 given by equation (14) above is sent through an attenuator 14R with an attenuation coefficient b to a band-pass filter (BPF) 15R so that only components within a frequency band requiring a phase control are sent to the first phase shifter 16R. The first phase shifter 16R is provided for controlling the phase so that the opposite phase components are reduced at the listener position.

The first phase shifter 16R includes four band-pass filters 16R1, 16R2, 16R3, 16R4 (not shown), and delay circuits 16R5, 16R6, 16R7, 16R8 (not shown) for introducing a delay in the transmission of the respective outputs.

The frequency band requiring a phase control is divided into four frequency bands by the band-pass filters 16R1, 16R2, 16R3, 16R4. The delay circuits 16R5, 16R6, 16R7, 16R8 introduce a predetermined delay in the transmission of signal in each frequency band so that the phase of each of the signals is shifted by ø11, ø12, ø13, and ø14, respectively. An amount of phase shift $\Phi_1$ provided by the first phase shifter 16R varies depending on the frequency.

The outputs of the delay circuits 16R5, 16R6, 16R7, 16R8 are added up in an adder 16R9 (not shown), and output as a signal R2. After the phase of the signal R2 is inverted, the signal R2 is sent to an adder 17L. The signal R2 is expressed as:

$$R2=b\cdot R1\angle\phi_1=b[S_R aS_L+(1-a)S_C]\angle\Phi 1 \quad (16)$$

A signal LR1 is output by the adder 17L. The signal LR1 is expressed as:

$$LR1=L_0-R2=S_L+S_C-b[S_R-aS_L+(1-a)S_C]\angle\Phi_1 \quad (17)$$

A signal (−R3) is produced by inverting the phase of R3 represented by equation (15) above, and transmitted to an adder 23L. The signal (−R3) and the signal LR1 are added up in the adder 23L, and a signal LR2 is output. The signal LR2 is expressed by the following equation, and sent to the output terminal 7L.

$$\begin{aligned} LR2 &= LR1-R3 \quad (18)\\ &= S_L+S_C-b[S_R-aS_L+(1-a)S_C]\angle\Phi_1-\\ &\quad c\cdot(S_R-aS_L+(1-a)S_C)\angle\Phi_2 \end{aligned}$$

Since the attenuation coefficients a, b, c and the delays $\Phi_1$ and $\Phi_2$ in equations (13) and (18) above are set so that, when virtual speakers given by the theory of sound image enhancement using the transfer functions obtained in the manner mentioned above are placed at the back of the listener, the frequency characteristic and phase characteristic of signals from the virtual speakers approximate to the frequency characteristic and phase characteristic of signals from the speakers 10L and 10R. As a result, an optimum space of sound image is achieved, and the listener can perceive a more faithful simulation of a live performance.

The number of processing steps in the DSP in the above-mentioned structure is calculated as follows.

In this structure, it is necessary to provide three attenuators, five BPFs, one equalizer, four delay circuits, seven adders, and one second phase shifter for each channel. It is also necessary to arrange the order of each attenuator to be 2, the order of each BPF to be 6, the order of the equalizer to be 6, the order of readout in each delay circuit to be 2, the order of writing in each delay circuit to be 2, the order of each adder to be 1, and the order of the second phase shifter to be 4.

The total order is given by the sum of products, i.e., (2×3)+(6×5)+(6×1)+(2×4)+(2×5)+(1×7)+(2×3)+(4×1)=77 steps. By comparing this order with the order, 128×2=256, when the FIR filter is used, it is understood that the order is reduced to about one third. It is therefore not necessary to use a high-speed DSP. Since an inexpensive DSP can be used, it is possible to reduce the cost.

Figure 3:
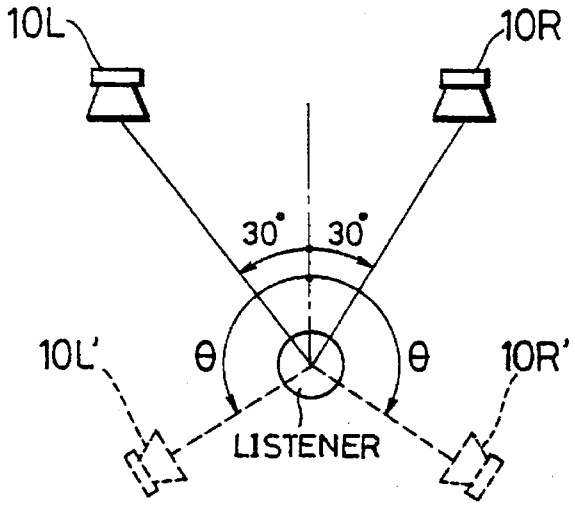
FIG. 3 is an explanatory view showing a relationship among a listener, speakers, and virtual speakers.
Figure 4:
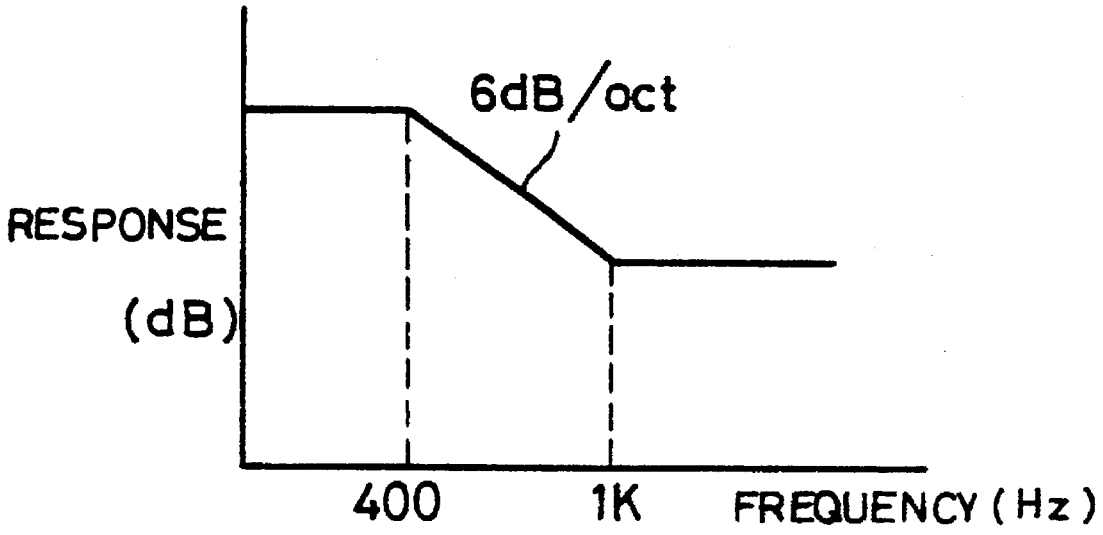
FIG. 4 shows a frequency characteristic of an equalizer.
Figure 5:
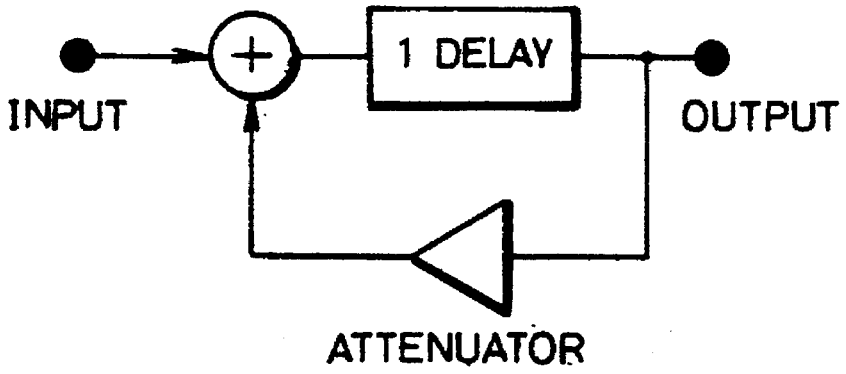
FIG. 5 is an explanatory view showing the structure of a second phase shifter.

When a drum, a piano and a saxophone are placed on the left, right and front-center positions with respect to the listener, respectively, the attenuation coefficients and the delays become as follows. Suppose that the speakers 10L and 10R are installed on lines directed laterally outwardly and forwardly at 30° on either side of the listener as illustrated in FIG. 3.

Denoting signals from these sound sources by $S_D$, $S_P$, and $S_S$, respectively, the left channel sound signal $L_0=S_D+S_S$ is input through the left channel input terminal 2L to the sound image enhancement apparatus 1, while the right channel sound signal $R_0=S_P+S_S$ is input through the right channel input terminal 2R to the sound image enhancement apparatus 1.

In this case, based on equations (18) and (13) above, the signal LR2 output from the output terminal 7L and the signal RL2 output from the output terminal 7R are expressed as follows.

$$LR2=S_D+S_S-b[S_P-aS_D+(1-a)S_S]\angle\Phi_1-c\cdot(S_P-aS_D+(1-a)S_S)\angle\Phi_2 \quad (19)$$

$$RL2=S_P+S_S-b[S_D-aS_P+(1-a)S_S]\angle\Phi_1-c\cdot(S_D-aS_P+(1-a)S_S)\angle\Phi_2 \quad (20)$$

If only signals of the drum are extracted from equations (19) and (20), i.e., if $S_P=S_S=0$, the signals LR2 and RL2 are expressed as:

$$LR2=S_D+abS_D\angle\Phi_1+acS_D\angle\Phi_2 \quad (21)$$

$$RL2=-(BS_D\angle\Phi_1+cS_D\angle\Phi_2) \quad (22)$$

As is known from equations (21) and (22), a phase term (a term including at least $\angle\Phi_1$ or $\angle\phi_2$) is added to the left channel without inversion, while the inverse of the phase term (indicated by a minus sign in equation (22)) is added to the right channel. The signals fall on both the ears of the listener in this state, and are then combined. As a result, a sound image is synthesized from the left channel signal at the position of the virtual speaker 10L'. In order to arrange each of the speaker angles θ shown in FIG. 3 between 120° and 150°, suppose that the sampling frequency is $f_S$, other coefficients are set, for example, as follows.

Namely, in this embodiment, a=0.7 to 1, b=0.9, c=0.7, d=0.4. The pass band of the band-pass filter 15L is between 200 Hz to 10 kHz. The band-pass filter 16L1 is a low-pass filter with a cut-off frequency of 500 Hz. The pass band of the band-pass filter 16L2 is between 500 Hz and 2 kHz. The pass band of the band-pass filter 16L3 is between 2 kHz and 5 kHz. The band-pass filter 16L4 is a high-pass filter with a cut-off frequency of 5 kHz. A delay given by the delay circuit 16L5 is between 8 $f_S$ and 10 $f_S$. The delay of the delay circuit 16L6 is between 5 $f_S$ and 8 $f_S$. The delay of the delay circuit 16L7 is between 4 $f_S$ and 7 $f_S$. The delay of the delay circuit 16L8 is between 3 $f_S$ and 6 $f_S$. The equalizer 19L has the frequency characteristic shown in FIG. 4. The second phase shifter 20L is a low-pass filter having the structure shown in FIG. 5 (a feedback by the attenuator is not higher than 0.7, and the position of the virtual speaker 10L' is adjusted by the feedback and the attenuation coefficient c of the attenuator 18L). With these settings, the phase and attenuation described by the sound image localization theory were obtained.

If only signals of the piano are extracted from equations (19) and (20) above, i.e., if $S_D=S_S=0$, the signals LR2 and RL2 are expressed as:

$$LR2=-(bS_P\angle\Phi_1+cS_P\angle\Phi_2) \quad (23)$$

$$RL2=S_P+abS_P\angle\Phi_1+acS_P\angle\Phi_2 \quad (24)$$

As is known from equations (23) and (24), the polarity of the phase term is opposite to that of the drum, the right sound source $S_P$ provides a phase shift of about 185° to 200° based on the phase shift and phase inversion of the signal LR2, and the signals are combined at the listener position. Consequently, a sound image is synthesized from the right channel signal $S_P$ at the position of the virtual speaker 10R'. In this case, the same conditions as for the drum are used.

If only signals of the saxophone are extracted from equations (19) and (20) above, i.e., if $S_D=S_P=0$, the signals LR2 and RL2 are expressed as:

$$LR2=S_S-b(1-a)S_S\angle\phi_1-c(1-a)S_S\angle\Phi_2 \quad (25)$$

$$RL2=S_S-b(1-a)S_S\angle\phi_1-c(1-a)S_S\angle\Phi_2 \quad (26)$$

In this case, since LR2=RL2, the sound image of the central saxophone is located in the center. However, the phase terms (second and third terms) become the factors of reducing LR2 (RL2). In order to prevent a reduction of LR2 (RL2), if it is arranged that a=1, all the phase terms become zero. However, in order to enhance the sound images of the drum and the piano, it is necessary to satisfy a<1. Then, in order to meet the respective conditions, it is arranged that a=0.9 in this embodiment.

Figure 6:
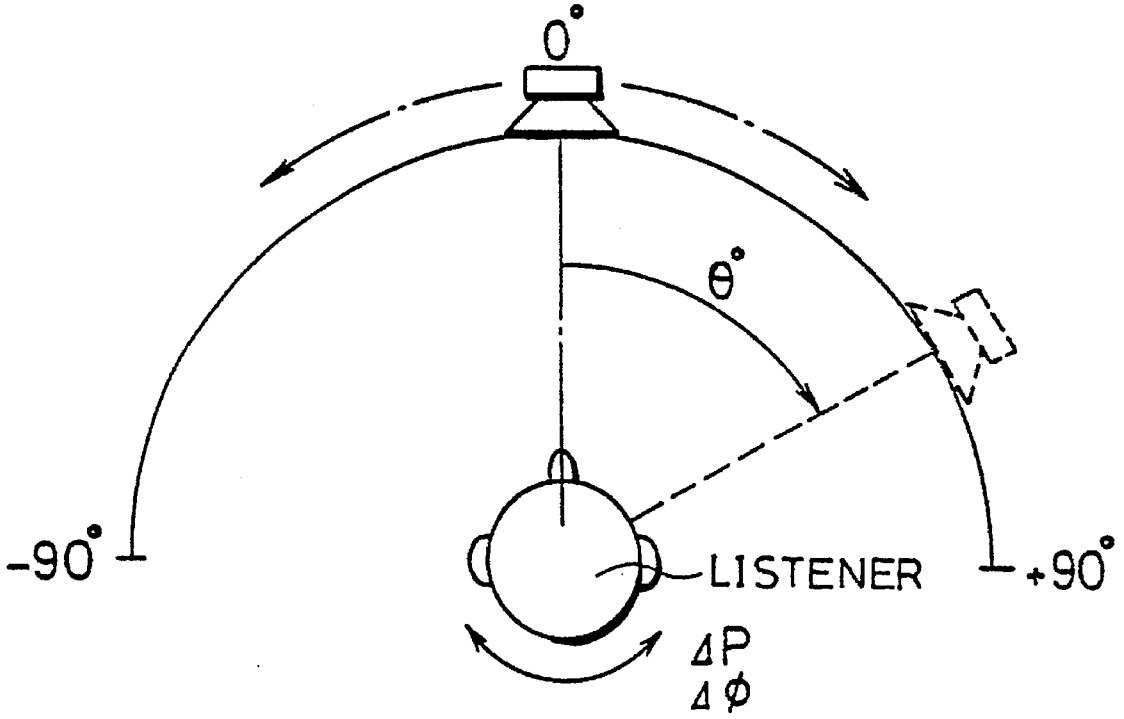
FIG. 6 is an explanatory view for explaining a theory of sound image localization.
Figure 7:
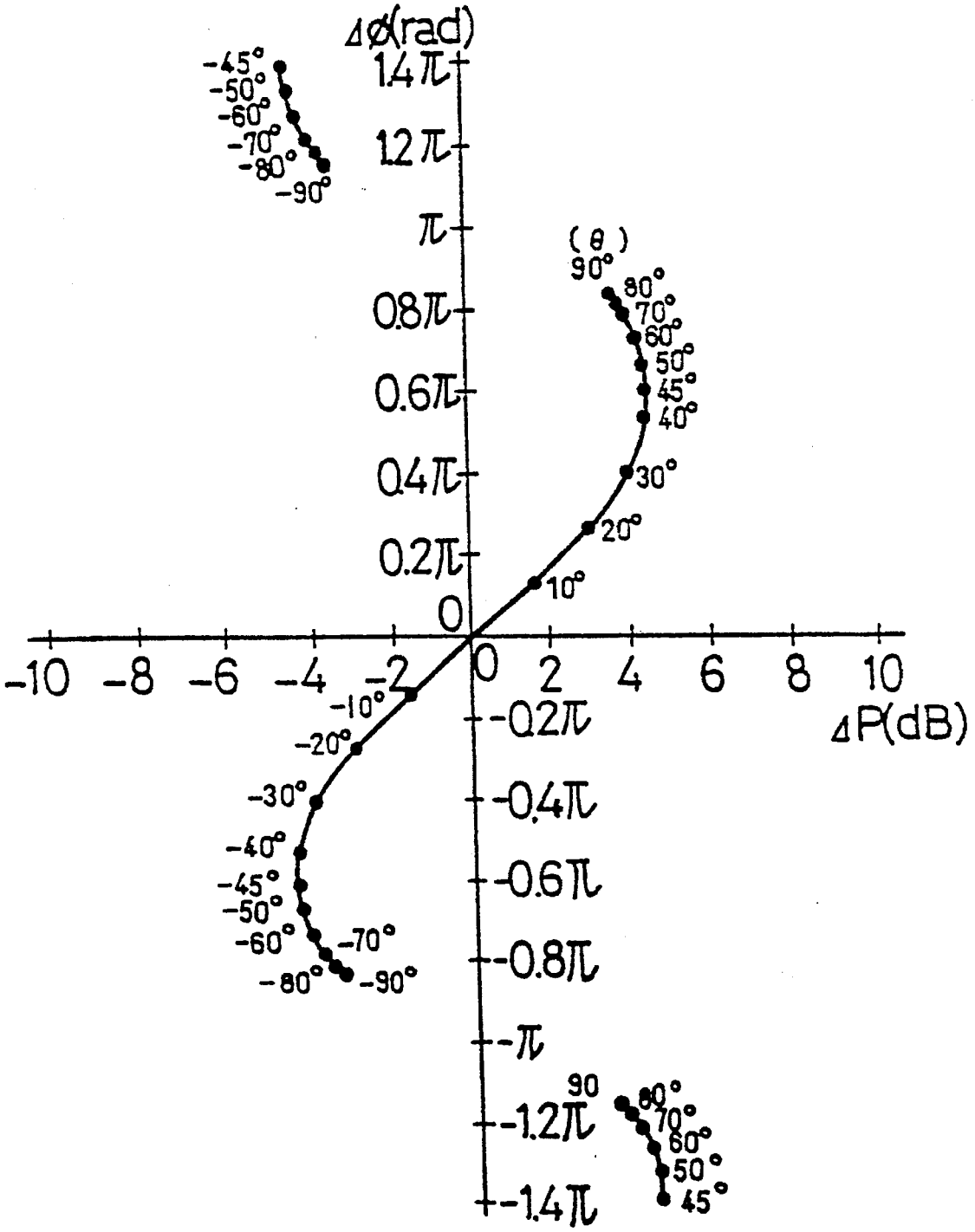
FIG. 7 is an explanatory view showing the level of a signal fell on the right ear relative to a signal at the entrance of the external auditory meatus of the left ear, and the phase difference between the signals, plotted at a frequency when real sound sources are moved.

Referring now to FIGS. 6 and 7, the following description discusses the theory of sound image localization.

A sound image produced by in-phase signals in stereo reproduction is generally said to be a sharp sound image. On the other hand, a sound image produced by signals with a phase difference or time difference is usually said to be vague.

Regarding the quality and localization of these sound images, in order to equalize the localization and quality of a sound image from a virtual sound source and those from the real sound source, it is not absolute but essential to arrange the differences in the level and phase of sound signals from the virtual sound source between the ears to be equal to those of sound signals from the real sound source. As illustrated in FIG. 6, suppose that the front position of the listener is a reference position, the real sound source was moved (θ) up to 90 degrees to the right and left with respect to the listener. The level (ΔP) of a signal fell on the right ear with respect to a signal at the entrance of the external auditory meatus of the left ear and the phase difference (ΔΦ) between the signals were plotted at a frequency of 500 Hz. FIG. 7 shows the result.

The combination of level differences and phase differences of signals given to the two (front left and front right) speakers was changed in various ways, and sound tests were carried out to evaluate the quality (naturalness) of the sound image. The results are as follows.

1) By giving a stimulation corresponding to a point on the curve of the locus of the real sound source to the entrance of the external auditory meatus of each ear of the listener by an arbitrary number of speakers placed in arbitrary directions, it is possible to create a sound image having the same quality as that from a real sound source, i.e., a natural sound image, in a direction comparable to the point with respect to the listener. More specifically, it is possible to obtain virtual sound sources in positions on lines laterally directed at 90° on either side of the listener by arranging the phase difference to be 0.95 π and varying the level difference.

2) When a stimulation corresponding to a point located out of this curve is given to each ear of the listener, the listener perceives a sound image whose orientation is equal to that from the real sound source but whose quality differs from that from the real sound source, i.e., an unnatural sound image. Specifically, the most natural sound image is created when the phase difference is 0.4π. A similar sound image is created if the level difference is zero when the phase difference is π or 0.9π.

Sound tests were carried out not only at 500 Hz, but also over a wideband. It was found from the results that it is necessary to perform processing according to the above-mentioned analysis up to about 1.8 kHz and that practically substantially satisfactory results were obtained without performing processing at higher frequency bands. The reason for this is that the limit of detection with respect to the phase difference between ears is significantly increased at frequencies not lower than 2 kHz.

A sound source located in a position α degrees off-axis from the front-center position is judged a rear sound source located in a direction shifted at (180-α) degrees from the front position, i.e., a so-called wrong judgement is made. The wrong judgement was made because the level difference and phase difference extremely approximate to each other.

In FIG. 7, similarly to the result 1) above, the data between ±45° and 90° is obtained because a vertical axis ΔΦ is a periodic function of a period of 2π. Namely, a natural sound image is obtained specifically by arranging the phase difference to be 1.05π.

Considering the above-mentioned theory, it is desirable to arrange the phase difference between the left and right signals to be about 0.95π or 1.05π at frequencies not higher than 2 kHz and the level difference to a value corresponding to an angle of the virtual speaker.

Namely, in FIG. 1, when only a left channel signal is input, the output LR2 of the left channel and the output RL2 of the right channel in the adder 23 are expressed by equations (21) and (22) above. Since $\angle\Phi_1=\cos\Phi_1+j\sin\Phi_1$, and $\angle\Phi_2=\cos\Phi_2+j\sin\Phi_2$, equations (21) and (22) are written as:

$$RL2=A+jB \tag{27}$$

$$LR2=C+jD \tag{28}$$

In equations (27) and (28), however, $A=b\cos\Phi_1+c\cos\Phi_2$, $B=b\sin\Phi_1+c\sin\Phi_2$, $C=1+ab\cos\Phi_1+ac\cos\Phi_2$, and $D=(ab\sin\Phi_1+ac\sin\Phi_2)$.

Based on LR2/RL2, a level x and a phase θ of the right channel with reference to the left channel are calculated by the following equations.

$$x=[(A^2+B^2)/(C^2+D^2)]^{1/2} \tag{29}$$

$$\theta=\tan^{-1}(A/B)+\tan^{-1}(D/C) \tag{30}$$

Namely, it is possible to realize a virtual sound source by setting x and θ to satisfy 3 dB≦x≦4 dB, and 0.95 π≦θ≦1.05π. The phase difference is obtained by adding π(180°) to θ.

The following description will explain the characteristics of the phase difference and level difference between left and right channels according to the sound image localization theory. For the sake of explanation, suppose that the right channel input signal $R_0$ is zero.

Figure 8:
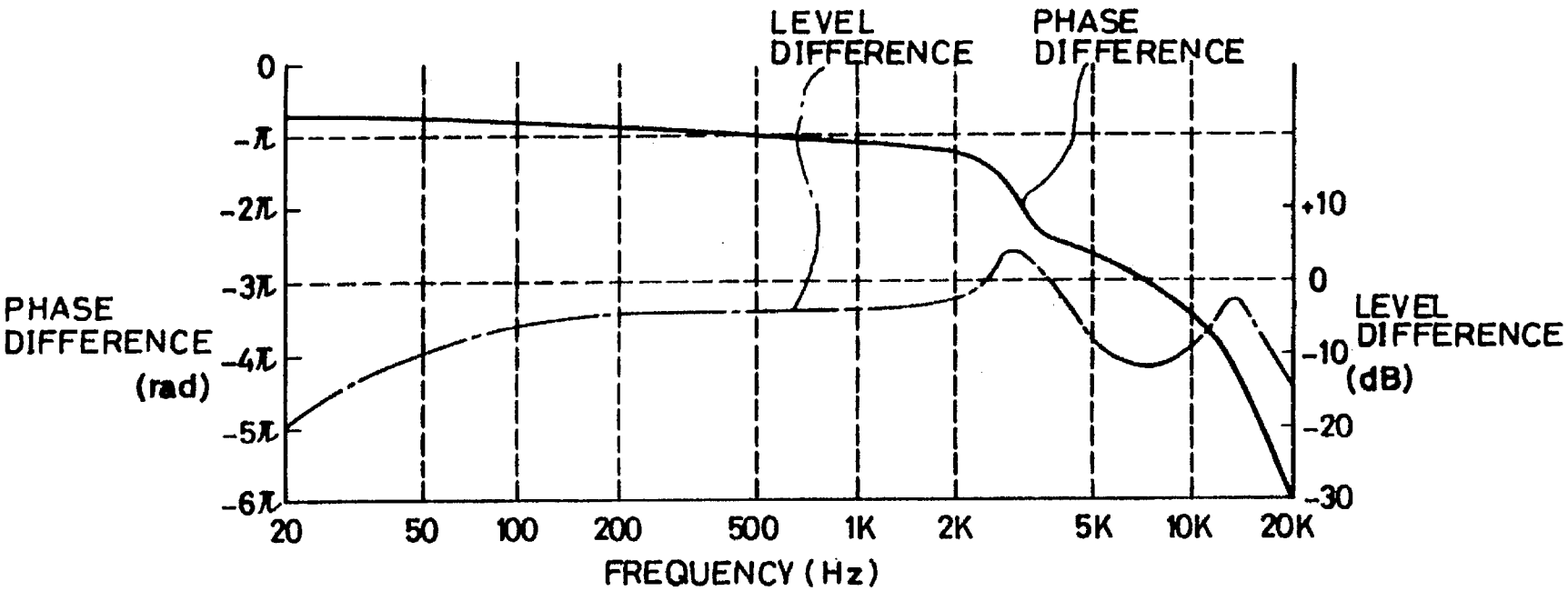
FIG. 8 is an explanatory view showing the frequency characteristic of a level difference and a phase difference in the right channel with respect to the left channel, introduced by a first phase shifter.

The phase difference and level difference between the signal LR1 based on the first phase shifter 16R and the signal RL1 based on the first phase shifter 16L vary as follows. As illustrated in FIG. 8, the phase difference varies within a range between (−π) and −(π+0.1 π) over a range of mid-frequency band (500 Hz to 2 kHz), while the phase difference varies within a range between −(π−0.1π) and (−π) at frequencies not higher than 500 Hz.

Figure 9:
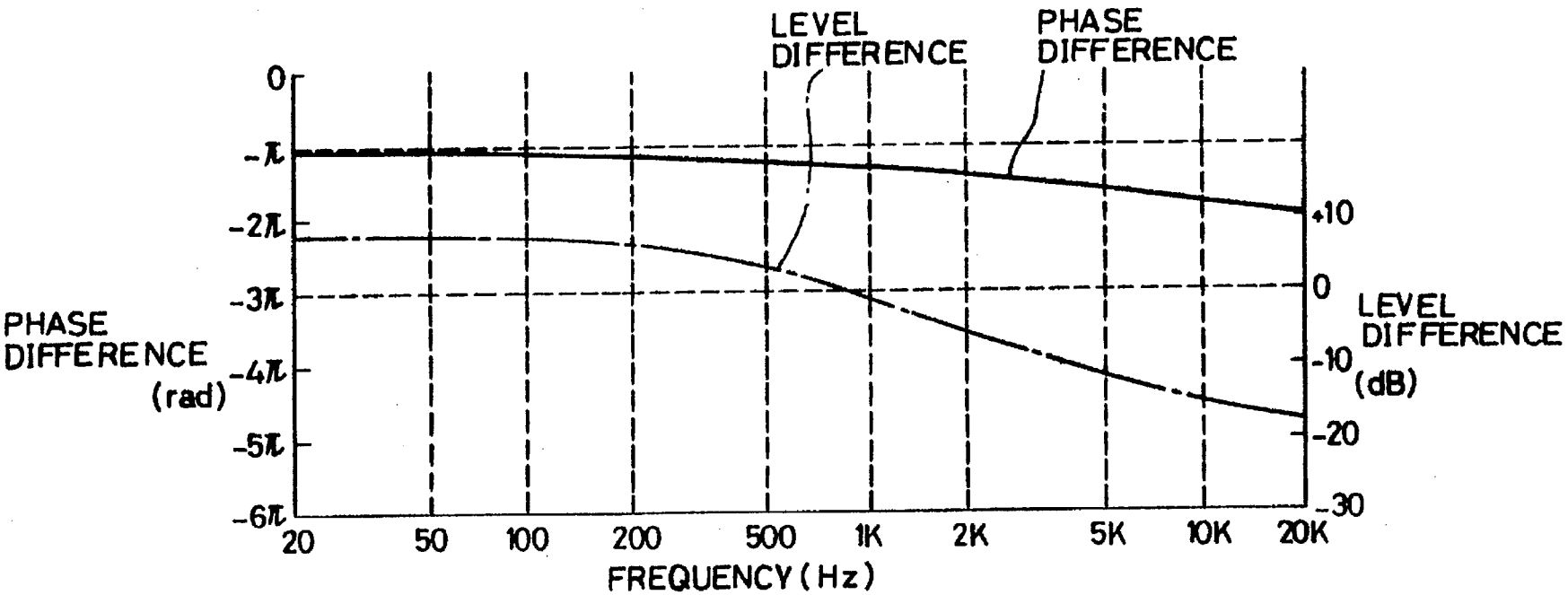
FIG. 9 is an explanatory view showing the frequency characteristic of an output signal of a second phase shifter in the right channel with respect to an input signal of the left channel.

The phase difference and the level difference between the signal R3 based on the second phase shifter 20R and the left channel sound signal $L_0$ vary as follows. As illustrated in FIG. 9, the phase difference varies within a range between (−π) and −(π+0.1π) over a range of low frequency band. The level difference is amplified by about (+8) dB over the range of low frequency band, and attenuated over a range of high frequency band as shown by the curve in FIG. 9.

Figure 10:
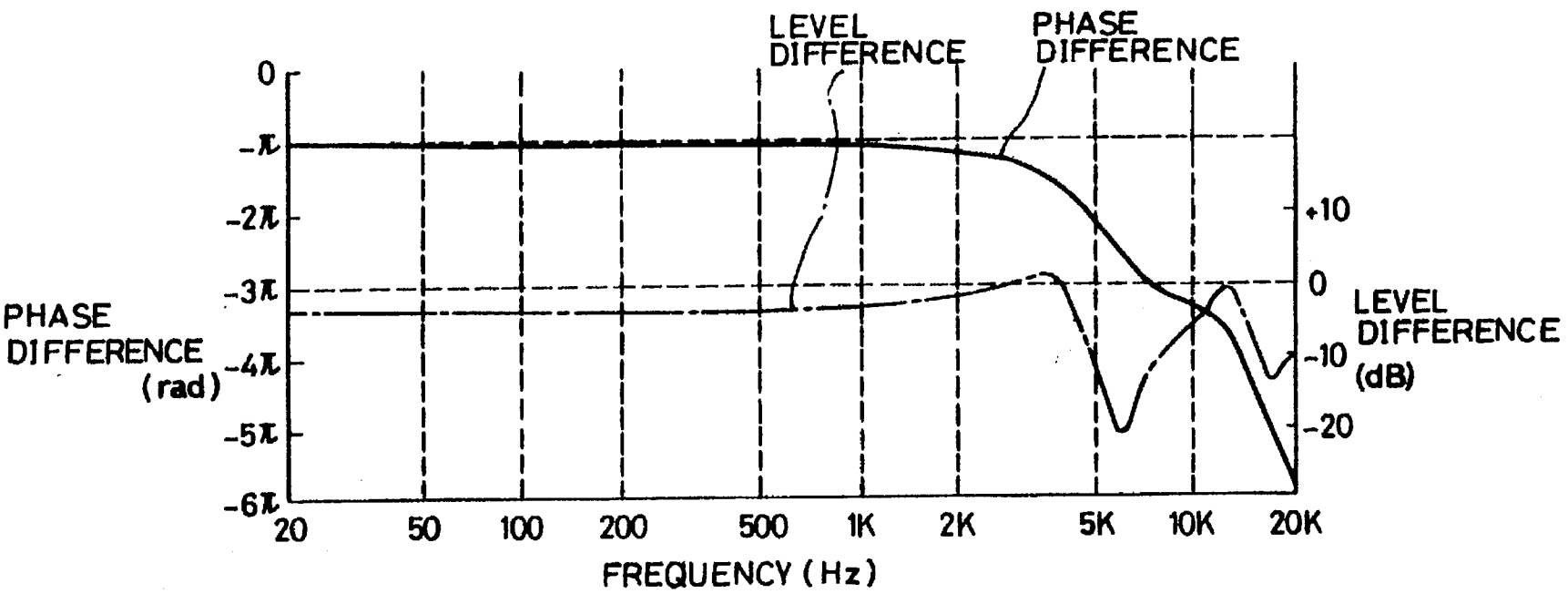
FIG. 10 is an explanatory view showing synthetic results of FIGS. 8 and 9.

FIG. 10 shows the combined characteristics of FIGS. 8 and 9. It is possible to achieve a phase difference of (−π±0.1π) and a level difference of (4 to 3) dB within a range of frequencies from 50 Hz to 1.8 kHz. These phase difference and the level difference are equal to the values taught by the sound image localization theory.

Figure 11:
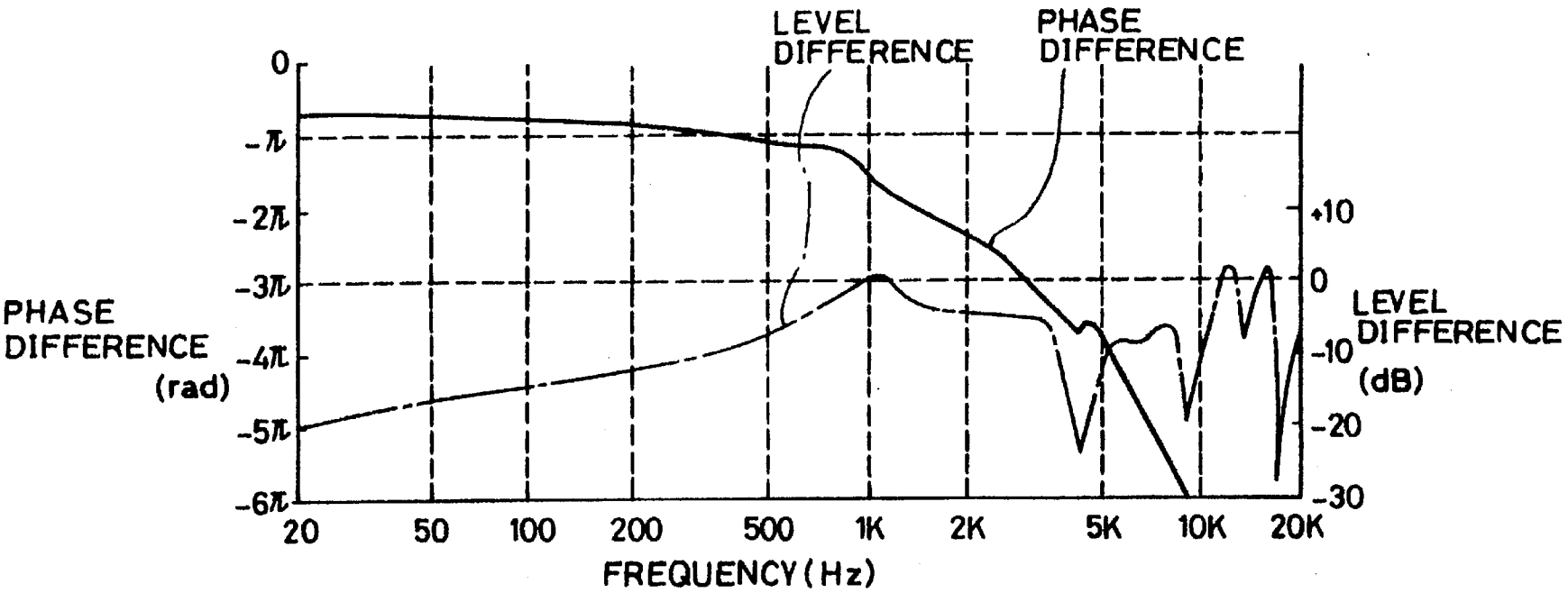
FIG. 11 is an explanatory view showing the frequency characteristic of a phase difference and level difference when the angle of a virtual speaker is 60°.
Figure 12:
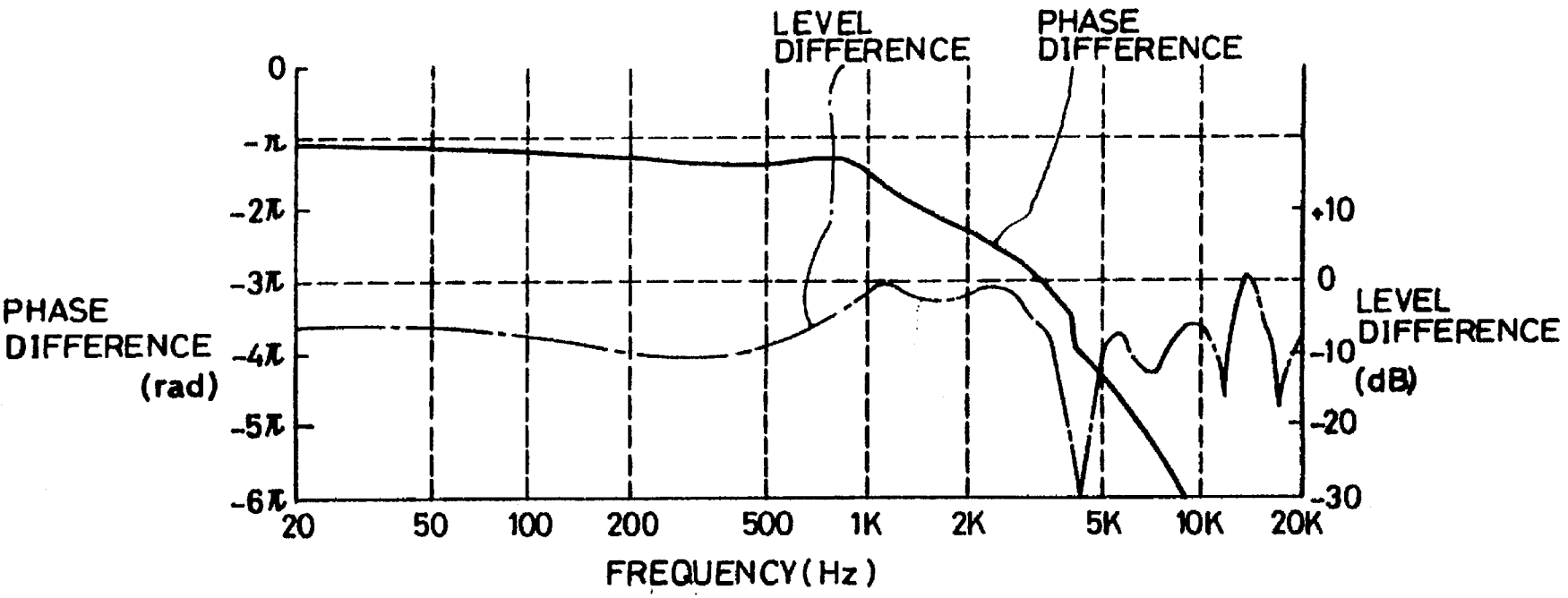
FIG. 12 is an explanatory view showing the frequency characteristic of a phase difference and level difference when the angle of the virtual speaker is 120°.

According to the sound image localization theory, it is possible to set the virtual speaker angle up to 90°. Since the symmetrical phase characteristics are shown between angles 0° to 90° and 180° to 90°, if the virtual speaker angle becomes equal to or larger than 90°, the phase control is infeasible. The characteristics when the virtual speaker angle was 60° and 120° were obtained by the transfer function characteristics. The results are shown in FIGS. 11 and 12. In comparison with the virtual speaker angle of 60°, when the virtual speaker angle is 120°, the increase of the level within a range of low frequency band becomes larger than the increase of the level within a range of high frequency band. Namely, the virtual speaker placed on a line directed laterally forwardly at 60° relative to the listener position byway of the first phase shifter 16R and 16L (see FIG. 8). Similar characteristics to those of a speaker angle 120° are obtained by using the equalizers 19R and 19L and the second phase shifters 20R and 20L (see FIG. 10), and a rear virtual speaker (with a virtual speaker angle between 90° and 180°) is simulated.

This is clearly explained by the fact that the phase difference characteristic depending on the first phase shifters 16R and 16L approximate to that of the front located virtual speaker (60°) (i.e., the phase difference characteristic of FIG. 8 and that of FIG. 11 approximate to each other) and that the phase difference characteristic obtained by the addition of the second phase shifters 20R and 20L approximates to that of the rear located virtual speaker (120°) (i.e., the phase difference characteristic of FIG. 10 and that of FIG. 12 approximate to each other).

Figure 13:
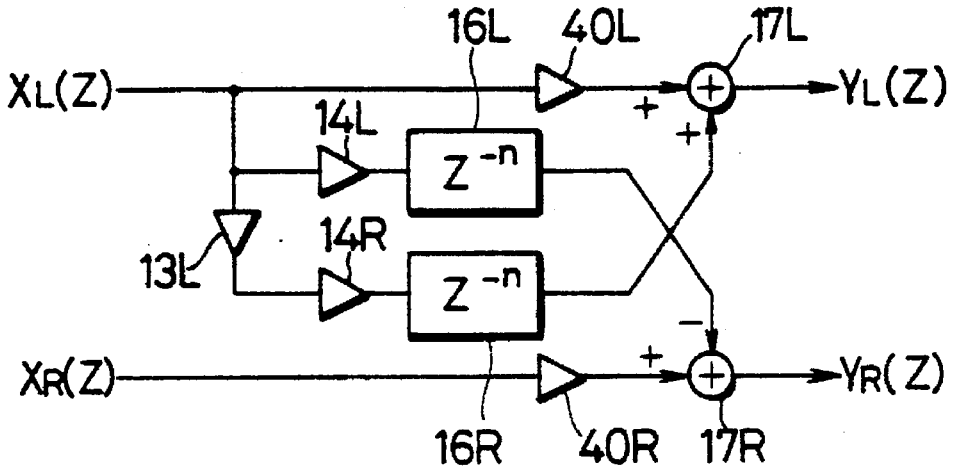
FIG. 13 is a diagram of an equivalent circuit of a simplified circuit of the first phase shifter.
Figure 14:
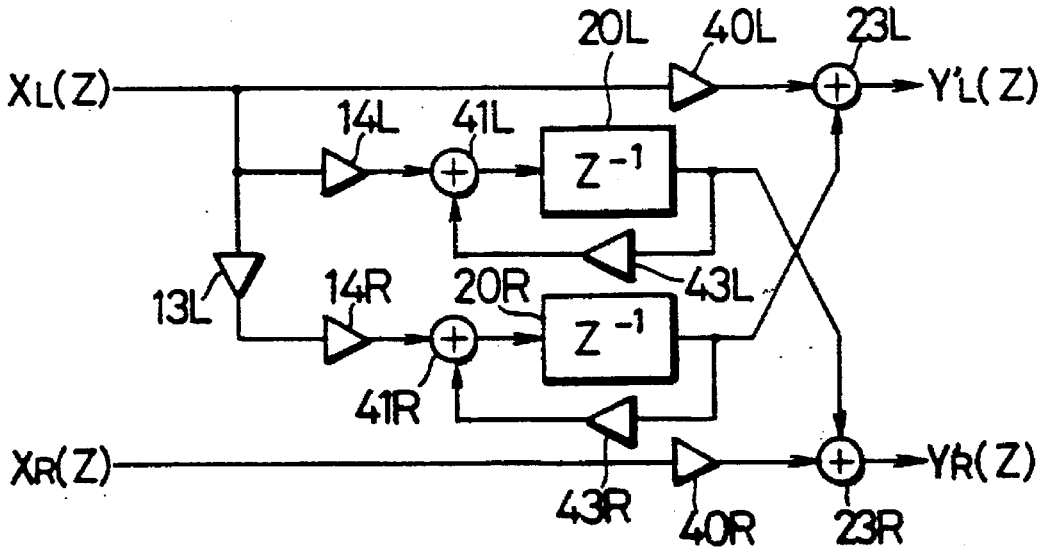
FIG. 14 is a diagram of an equivalent circuit of a simplified circuit of a second phase shifter.

Referring now to FIGS. 13 and 14, the following description will explain how to obtain the respective attenuation coefficients for sound image enhancement for only one channel signal (for example, for only a left channel signal). The members having the same function as in the above-mentioned embodiment will be designated by the same code and their description will be omitted.

The characteristic depending on the first phase shifter is obtained by an equivalent circuit of a simplified circuit shown in FIG. 13. In order to prevent an overflow of an arithmetic operation of coefficient, the left channel stereo signal L (right channel stereo signal R) is attenuated by an attenuator 40L (40R). A delay coefficient n of each of the delay circuits 16L and 16R varies depending on the frequency. In the following given example, a specific frequency is set at 400 Hz.

Assuming that the attenuation coefficient of the attenuator 40L (40R) is 0.7, the input of the left channel is $X_L(Z)$, the input of the right channel is $X_R(Z)=0$, the output of the left channel is $Y_L(Z)$ and the output of the right channel is $Y_R(Z)$, a transfer function $H_L(Z)$ of the left channel and a transfer function $H_R(Z)$ of the right channel are expressed by equations (31) and (32) below.

$$H_L(Z)=0.7+abZ^{-n} \quad (31)$$

$$H_R(Z)=-bZ^{-n} \quad (32)$$

When $Z=e^{j\omega T}$ (where ω is an angular frequency, and T is a sampling frequency), equations (31) and (32) are written as $$H_L(e^{j\omega T})=0.7+abe^{-j\omega nT} \quad (33)$$

$$H_R(e^{j\omega T})=-be^{-j\omega nT} \quad (34)$$

The frequency response is given based on equations (33) and (34).

According to equations (33) and (34), the transfer function $H_{RL}(Z)$ of the left channel output with respect to the right channel output is expressed as $$H_{RL}(Z)=H_L(Z)/H_R(Z)=H_L(e^{j\omega T})/H_R(e^{j\omega T})=(0.7e^{j\omega nT}+ab)/(-b) \quad (35)$$

The level of widening of a sound image is set at 60° by the first phase shifter. According to the theory of sound image enhancement, by arranging the level of $H_{RL}(e^{j\omega T})$ and the phase to be 4.5 dB and 0.05π (the minus sign being ignored), respectively, the following equations are established.

$$[(ab+0.7\cos(\omega nT))^2+(0.7\sin(\omega nT)^2]^{1/2}/b=4.5\text{ dB}\simeq 1.68 \quad (36)$$

$$[0.7\sin(\omega nT)/(0.7\cos(\omega nT)+ab)]=\tan(0.05\pi) \quad (37)$$

In equation (36), assuming that b is a positive number and a=0.9, when solving b in the equation $(a^2-2.82)b^2+1.4\cos(\omega nT)ab+0.49=0$, equations (36) and (37) above are written as:

$$b=[1.26\cos(\omega nT)+(1.59\cos^2(\omega nT)+3.93)^{1/2}]/4.02 \quad (38)$$

$$0.7\sin(\omega nT)=0.158\times(0.7\cos(\omega nT)+0.9b) \quad (39)$$

According to equations (38) and (39), when the specific frequency is 400 Hz, if the sampling frequency is set at 44.1 kHz (=1/T), the delay coefficient n=6 and the attenuation coefficient b=0.87 are obtained. When the specific frequency is 2 kHz, if the sampling frequency is set at 44.1 kHz, the delay coefficient n=2 and the attenuation coefficient b=0.87 are obtained. Thus, the delay coefficient n is determined depending on the specific frequency. The delay coefficient n is finally determined by dividing the frequencies lower than 5 kHz into four ranges because of the amount of calculation and by performing an adjustment with reference to the values given by the equations so that the phase angle is obtained at the center frequency of each range.

The characteristic depending on the second phase shifter is obtained by an equivalent circuit of a simplified circuit shown in FIG. 14. Similarly to the first phase shifter, denoting the attenuation coefficient of an attenuator. 43L (43R) by K, a transfer function $h_L(Z)$ of the left channel and a transfer function $h_R(Z)$ of the right channel are expressed by equations (40) and (41) below. The output of the attenuator 14L (14R) and the output of the attenuator 43L (43R) are added up in the adder 41L (41R), and sent to the second phase shifter 20L (20R).

$$h_L(Z)=0.7+[acZ^{-1}/(1-KZ^{-1})] \quad (40)$$

$$h_R(Z)=-cZ^{-1}/(1-KZ^{-1}) \quad (41)$$

The transfer function $h_{TL}(Z)$ of the output of the adder 23L in FIG. 1 and the transfer function $h_{TR}(Z)$ of the output of the adder 23R are equal to those obtained by adding transfer functions $H_L(Z)$, $H_R(Z)$ of the first phase shifter to $h_L(Z)$, $h_R(Z)$, respectively, without repetition of the same term, and expressed as $$h_{TL}(Z)=0.7+abZ^{-n}+[acZ^{-1}/(1-KZ^{-1})] \quad (42)$$

$$h_{TR}(Z)=-[bZ^{-n}+[cZ^{-1}/(1KZ^{-1})]] \quad (43)$$

When the numerical values a, b and n related to the first phase shifter are substituted for equations (42) and (43) and when the transfer function of the left channel output with respect to the right channel output is denoted by $h_{RL}(Z)$, $h_{RL}$ is given by:

$$h_{RL}(Z)=h_{TL}(Z)/h_{TR}(Z) \quad (44)$$

Assuming that $Z=e^{j\omega T}$ and c is a positive value not larger than 1, when K and c in the equation of $h_{RL}$ are calculated so that the level is 3 dB and the phase is 0.05π, K=0.77 and c=0.63 are obtained.

The attenuation coefficient of each of the attenuators is obtained for the case where the first phase shifter and the second phase shifter are provided, and the sound image enhancement characteristic shown in FIG. 10 is obtained as mentioned above. The values of the attenuation coefficients are not limited to the above-mentioned values. If K and c are positive values not larger than 1 and set to prevent an overflow in the calculation of the circuit, the sound image enhancement characteristic shown in FIG. 10 is obtained.

The following description explains how a sound image is oriented to the back of the listener by approximating the level within a range of high frequency band to the characteristic depending on the transfer function.

Figure 15:
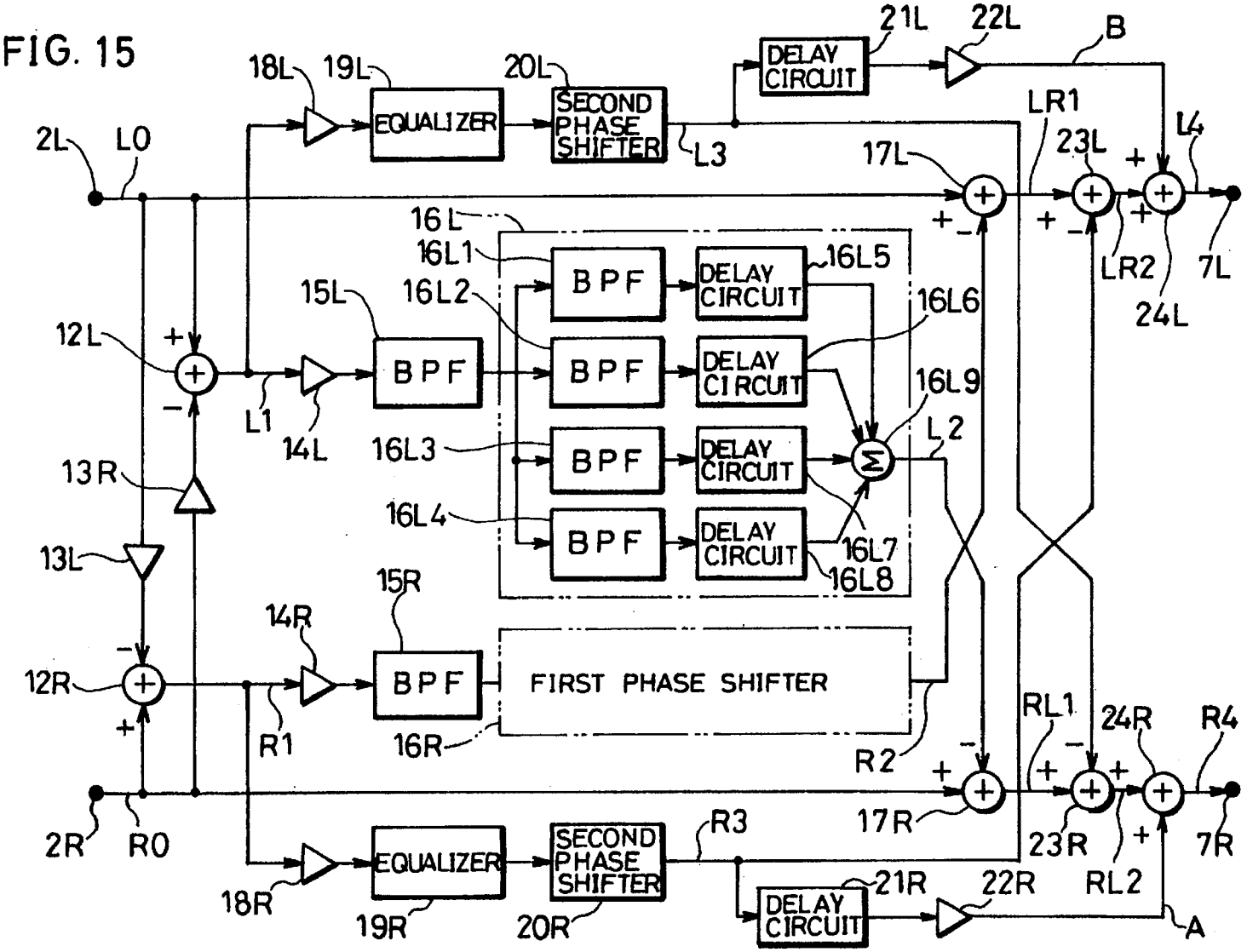
FIG. 15 is a block diagram showing an example of the structure of essential sections of another sound image enhancement apparatus of the present invention.

An example given here with reference to FIG. 15 differs from the structure shown in FIG. 1 due to the following points 1) and 2). 1) An adder 24L (third summing means) is provided between the adder 23L and the output terminal 7L, the output signal L3 of the second phase shifter 20L is delayed and attenuated by a delay circuit 21L (delaying and attenuating means, delayed phase $\Phi_3$) and an attenuator 22L (delaying and attenuating means, attenuation coefficient d) and input to the adder 24L, and the output signal LR2 of the adder 23L is also input to the adder 24L. 2) An adder 24R (third summing means) is provided between the adder 23R and the output terminal 7R, the output signal R3 of the second phase shifter 20R is delayed and attenuated by a delay circuit 21R (delaying and attenuating means, delayed phase $\Phi_3$) and an attenuator 22R (delaying and attenuating means, attenuation coefficient d) and input to the adder 24R, and the output signal RL2 of the adder 23R is also input to the adder 24R.

In the above-mentioned structure, a signal $A=(R3\angle\Phi_3)\cdot d$ to be sent to the adder 24R is written as:

$$A=c\cdot d(S_R-aS_L+(1-a)S_C)(\angle\Phi_2+\angle\Phi_3) \tag{45}$$

A signal $B=(L3\angle\Phi_3)\cdot d$ to be sent to the adder 24L is expressed as:

$$B=c\cdot d(S_L-aS_R+(1-a)S_C)(\angle\Phi_2+\angle\Phi_3) \tag{46}$$

Consequently, a signal R4 given by equation (47) below is output from the output terminal 7R, while a signal L4 expressed by equation (48) below is output from the output terminal 7L.

$$\begin{aligned} R4 = {} & S_R+S_C-b[S_L-aS_R+(1-a)S_C]\angle\Phi_1- \\ & c\cdot(S_L-aS_R+(1-a)S_C)\angle\Phi_2+ \\ & c\cdot d(S_R-aS_L+(1-a)S_C)(\angle\Phi_2+\angle\Phi_3) \end{aligned} \tag{47}$$

$$\begin{aligned} L4 = {} & S_L+S_C-b[S_R-aS_L+(1-a)S_C]\angle\Phi_1- \\ & c\cdot(S_R-aS_L+(1-a)S_C)\angle\Phi_2+ \\ & c\cdot d(S_L-aS_R+(1-a)S_C)(\angle\Phi_2+\angle\Phi_3) \end{aligned} \tag{48}$$

For instance, when a drum, a piano, a saxophone are placed on the left, right and front-center positions, respectively, the signals L4 and R4 are expressed by equations (49) and (50) below, respectively. The members having the same function as in the above-mentioned embodiment will be designated by the same code and their description will be omitted. Other conditions are the same as those mentioned above.

$$\begin{aligned} L4 = {} & S_D+S_S-b[Sp-aS_D+(1-a)S_S]\angle\Phi_1- \\ & c\cdot(Sp-aS_D+(1-a)S_S)\angle\Phi_2+ \\ & c\cdot d(S_D-aSp+(1-a)S_S)(\angle\Phi_2+\angle\Phi_3) \end{aligned} \tag{49}$$

-continued $$\begin{aligned} R4 = {} & Sp+S_S-b[S_D-aSp+(1-a)S_S]\angle\Phi_1- \\ & c\cdot(S_D-aSp+(1-a)S_S)\angle\Phi_2+ \\ & c\cdot d(Sp-aS_D+(1-a)S_S)(\angle\Phi_2+\angle\Phi_3) \end{aligned} \tag{50}$$

In equations (49) and (50), supposing that $S_P=S_S=0$, when only signals of the drum are extracted, the signals L4 and R4 are written as:

$$L4=S_D+abS_D\angle\Phi_1+caS_D\angle\Phi_2+cdS_D(\angle\Phi_2+\angle\Phi_3) \tag{51}$$

$$R4=-[bS_D\angle\Phi_1+cS_D\angle\Phi_2+cdaS_D(\angle\Phi_2+\angle\Phi_3)] \tag{52}$$

Similar to equations (25) and (26) above, a phase term $(\angle\Phi_2+\angle\Phi_3)$ is further added to the right channel in addition to the inverted phase term, and a speaker angle θ between 120° and 150° is obtained. Moreover, high frequency band, and mid and low frequency bands are corrected by setting the attenuation coefficient d between 0.2 and 0.5.

Figure 16:
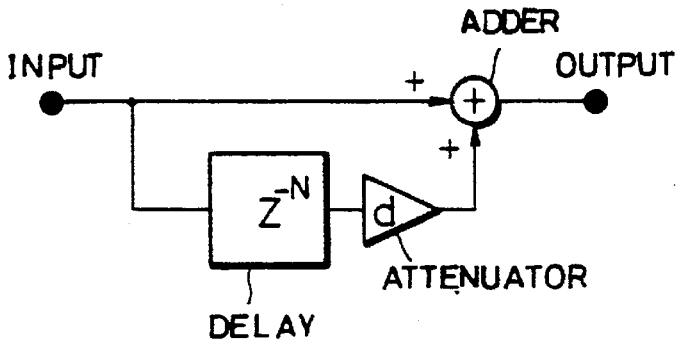
FIG. 16 is a diagram of an equivalent circuit, which shows that delaying and attenuating means of the present invention forms a type of a comb filter.

The delay circuit 21L and the attenuator 22L (or the delay circuit 21R and the attenuator 22R) form a kind of a comb filter, and its equivalent circuit is shown in FIG. 16. Suppose that the delay is N and the attenuation coefficient is d, the frequency characteristic of the comb filter is obtained based on the impulse response. A transfer function H(Z) shown in FIG. 16 is expressed as:

$$H(Z)=1+d\cdot Z^{-N} \tag{53}$$

Here, if $Z=e_{j\omega t}$, equation (53) is written as:

$$H(e^{j\omega t})=1+d\cdot e^{-jN\omega t}=d(1+e^{-jN\omega t})+(1-d) \tag{54}$$

According to the Euler's equation, equation (54) is developed to equation (55) below.

$$H(^{ej\omega t})=d(2\cos(N\omega t/2)\cdot e_{jN\omega t}/2)+(1-d) \tag{55}$$

Figure 17:
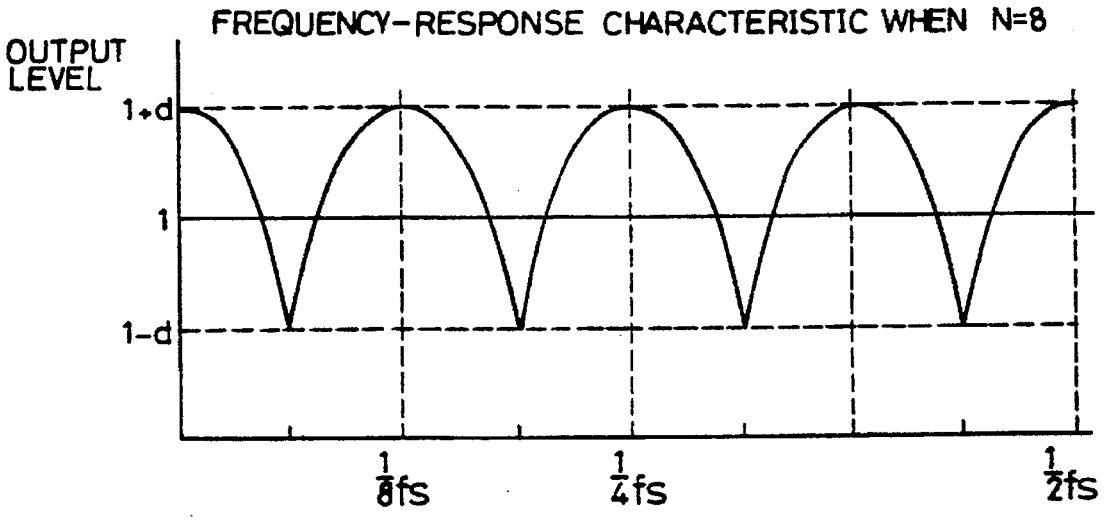
FIG. 17 is an explanatory view showing the frequency characteristic when N=8 in FIG. 16.

As is clear from equation (55), the amplitude of $H(e_{jN\omega t})$ changes at $2d\cdot\cos(N\omega t/2)$. Moreover, since $e^{-jN\omega t}/2$ is a periodic function, the maximum value (peak value) of $H(e^{jN\omega t})$ becomes (1+d) which is comparable to a point of $(\cos(N\omega t/2)=1)$, while the minimum value (dip value) becomes (1−d) which is comparable to a point of $(\cos(N\omega t/2)=0)$. At this time, if N is an integral multiple of 2, the comb filter shown in FIG. 16 exhibits a frequency characteristic which varies periodically (change at a frequency corresponding to ⅛ of the sampling frequency $f_s$) as shown in FIG. 17. In FIG. 17, it is arranged that N=8.

Consequently, it is possible to correct the high frequency band, and the mid and low frequency bands by adding up the signal LR2 output from the adder 23L and the signal B transmitted through the delay circuit 21L and the attenuator 22L in the adder 24L, and adding up the signal RL2 output from the adder 23R and the signal A transmitted through the delay circuit 21R and the attenuator 22R in the adder 24R. More specifically, by setting the amount of delay N=8 and the attenuation coefficient d=0.4, the high frequency band is corrected and the level is stabilized in the vicinity of (−3 dB) in a frequency band between a low frequency and 1.8 kHz.

Figure 18:
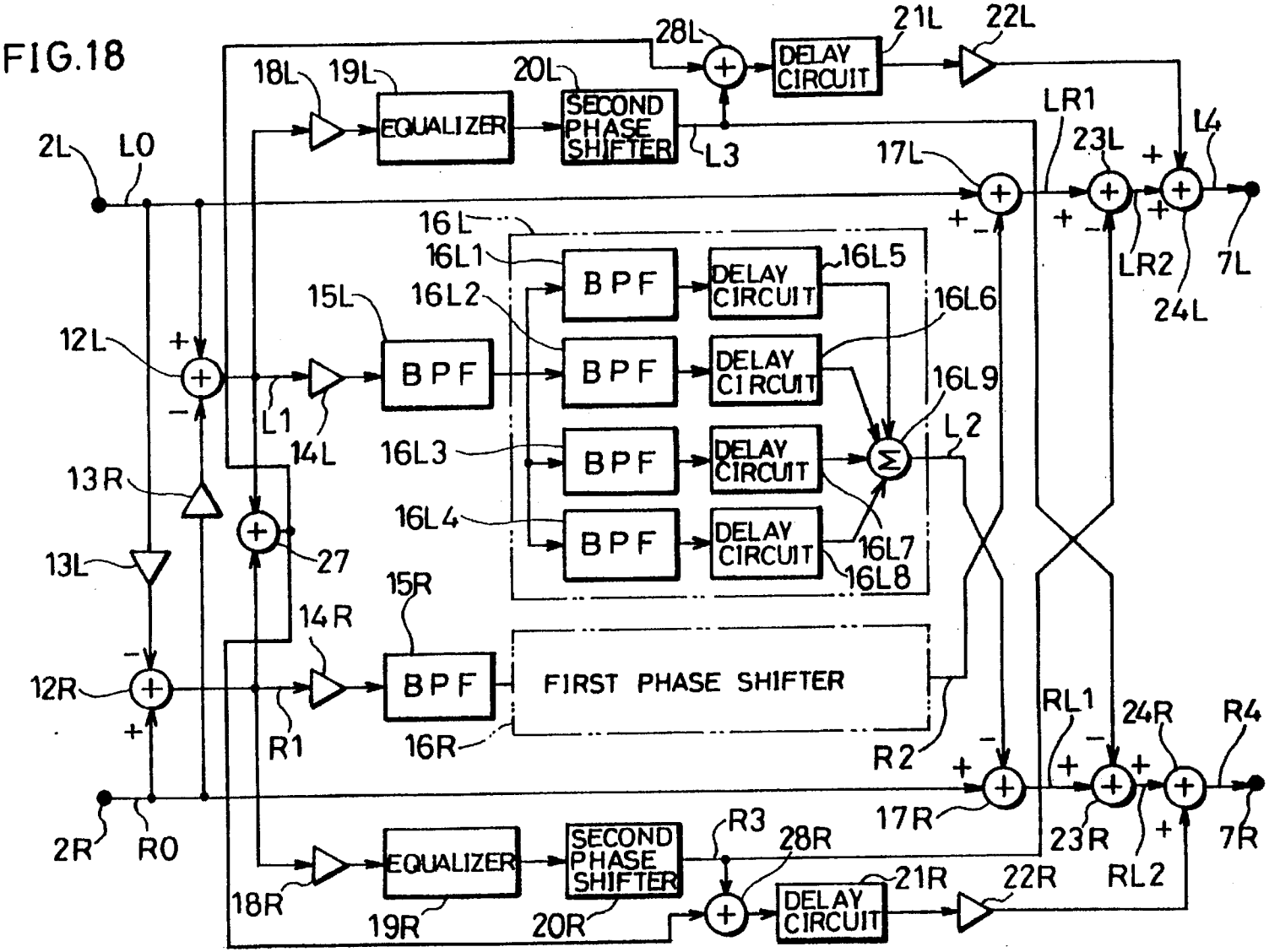
FIG. 18 is a block diagram showing the structure of essential sections of another sound image enhancement apparatus of the present invention.

Referring now to FIG. 18, the following description will discuss another embodiment which prevents a reduction of the central signal level by the phase term in equations (49) and (50) above. The members having the same function as in FIG. 15 will be designated by the same code and their description will be omitted.

The structure of FIG. 18 differs from that of FIG. 15 because of the following two points. Namely, the structure of FIG. 18 is based on the structure of FIG. 15, and further includes an adder 27 for adding up the output of the adder 12L and the output of the adder 12R. In the structure of FIG. 18, unlike the structure where output of the second phase shifter 20L (20R) is directly sent to the delay circuit 21L (21R) as shown in FIG. 15, an adder 28L (28R) for adding up the output of the second phase shifter 20L (20R) and the output of the adder 27 is additionally provided, and the output of the adder 28L (28R) is sent to the delay circuit 21L (21R).

According to the structure of FIG. 18, the output (L1+R1) of the adder 27 is expressed as:

$$(L1+R1)=S_D-aS_P+(1-a)S_S+S_P-aS_D+(1-a)\,S_S=(1-a)[S_D+S_P+2S_S]\text{tm} \quad (56)$$

A signal (L1+R1+L3) to be input to the delay circuit 21L is expressed as:

$$L1+R1+L3=(1-a)[S_D+S_P+2S_{S1}+c\cdot(S_D-aS_P+(1-a)S_S)\angle\Phi_2 \quad (57)$$

A signal d(L1+R1+L3)$\angle\Phi_3$ is sent to the adder 24L. Therefore, the output L4 of the adder 24L is written as:

$$\begin{aligned} L4 &= LR2+d(L1+R1+L3)\angle\Phi_3 \quad (58)\\ &= S_S-b(1-a)S_S\angle\Phi_1-c(1-a)S_S\angle\Phi_2+\\ &\quad dc(1-a)S_S(\angle\Phi_2+\angle\Phi_3)+\\ &\quad 2d(1-a)S_S\angle\Phi_3=R4 \end{aligned}$$

In equation (58), if the phases $\Phi_1$ to $\Phi_3$ are ignored with respect to the frequency components of the mid and low frequency bands (i.e, $\angle\Phi_1\simeq\angle\Phi_2\simeq\angle\Phi_3\simeq\angle\Phi_2+\angle\Phi_3\simeq 1$), L4 is written as $$L4=R4=S_S+(1-a)[2d+dc-(b+c)]S_S \quad (59)$$

Meanwhile, the following equation is established.

$$(1-a)[2d+dc-(b+c)]\simeq 0 \quad (60)$$

Therefore, the central signal level is not lowered, and the volume of central sound is automatically corrected irrespectively of the value of a. For example, if a=0.9, b=0.9, c=0.6 and d=0.4, the equation $(1-a)[2d+dc-(b+c)]=-0.046$ is obtained. Thus, it is possible to reduce the attenuation to about 0.4 dB in the voltage ratio. On the other hand, in the structure of FIG. 1, since $(1-a)[dc-(b+c)]=-0.126$, an attenuation of about 1 dB occurs in the voltage ratio. The level about 0.4 dB is an ignorable level which can hardly be perceived by the ears of a human.

The above description explains an example in which processing by the first phase shifter and processing by the second phase shifter are performed in parallel. Next, with reference to FIG. 19, the following description will discuss another embodiment in which the processing by the first phase shifter and the processing by the second phase shifter are performed in sequence. The members having the same function as in FIG. 15 will be designated by the same code and their description will be omitted.

Figure 19:
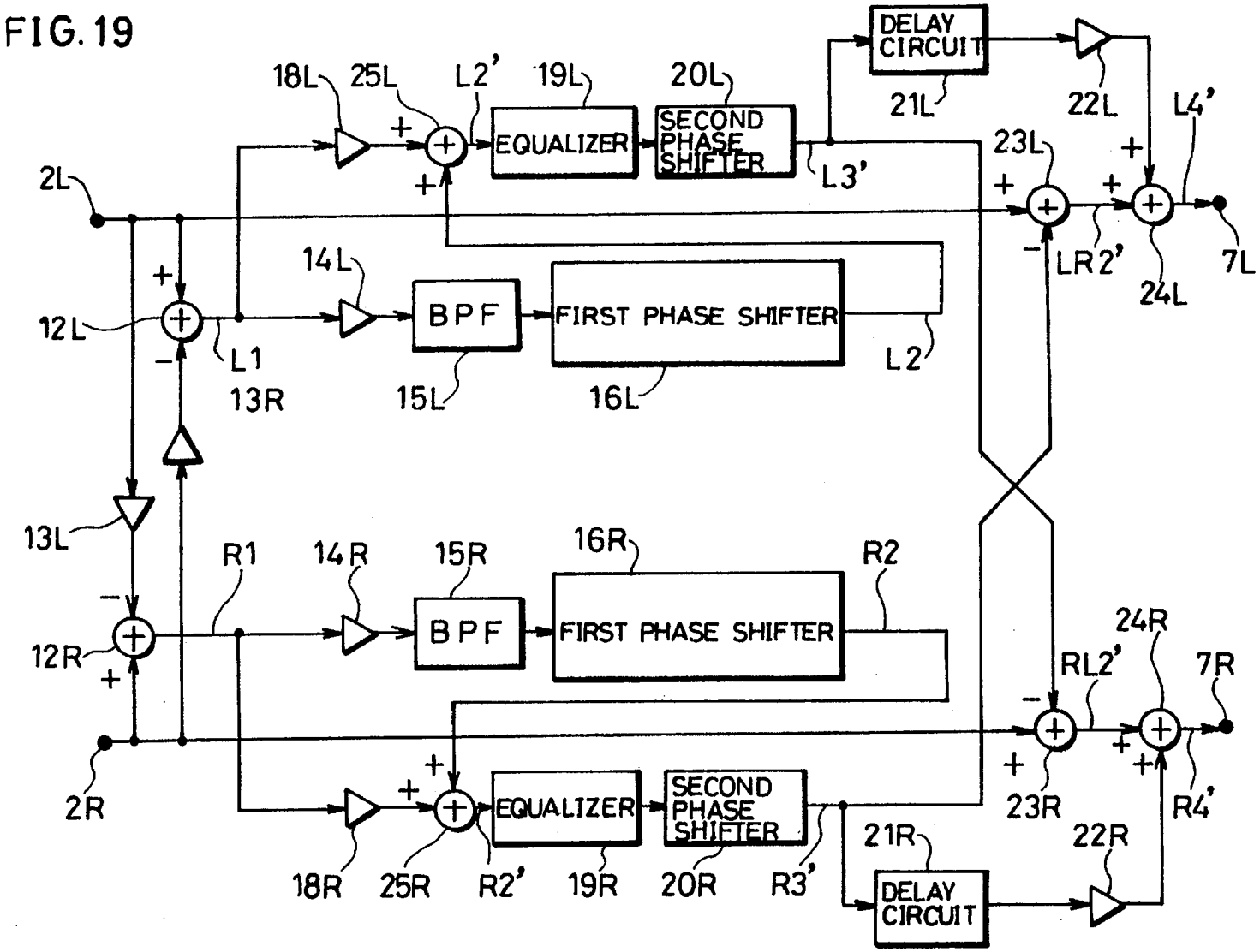
FIG. 19 is a block diagram showing the structure of essential sections of still another sound image enhancement apparatus of the present invention.

The structure of FIG. 19 includes an adder 25L (25R) for adding up the output of an attenuator 18L (18R) and the output L2 (R2) of the first phase shifter 16L (16R), but does not include the adder 17R (17L) shown in the structure of FIG. 15. Namely, the output L2 (R2) of the first phase shifter 16L (16R) is sent to the adder 25L (25R). The reference numerals in the brackets correspond to members of the other channel.

An output L2' of the adder 25L is expressed as:

$$\begin{aligned} L2' &= c\cdot L1+L2 \quad (61)\\ &= b[S_L-aS_R+(1-a)S_C]\angle\Phi_1+\\ &\quad c[S_L-aS_R+(1-a)S_C] \end{aligned}$$

Suppose that the output of the second phase shifter 20L is L3', the following equation is given.

$$\begin{aligned} L3' &= L2'\angle\Phi_2 \quad (62)\\ &= b[S_L-aS_R+(1-a)S_C](\angle\Phi_1+\angle\Phi_2)+\\ &\quad c[S_L-aS_R+(1-a)S_C]\angle\Phi_2 \end{aligned}$$

An output –L3' is produced by inverting the phase of the output L3', and then sent to the adder 23R. In the adder 23R, –L3' and a signal $S_R$ are added up. Supposing that the output of the adder 23R is RL2', the following equation is given.

$$\begin{aligned} RL2' &= S_R+S_C-L3' \quad (63)\\ &= S_R+S_C-\\ &\quad b[S_L-aS_R+(1-a)S_C](\angle\Phi_1+\angle\Phi_2)-\\ &\quad c[S_L-aS_R+(1-a)S_C]\angle\Phi_2 \end{aligned}$$

Similarly, with respect to the right channel, denoting the output of the adder 25R by R2', the output of the second phase shifter 20R by R3', and the output of the adder 23L by LR2', the following equations are given.

$$\begin{aligned} R2' &= b[S_R-aS_L+(1-a)S_C]\angle\Phi_1+ \quad (64)\\ &\quad c[S_R-aS_L+(1-a)S_C]\\ R3' &= b[S_R-aS_L+(1-a)S_C](\angle\Phi_1+\angle\Phi_2)+ \quad (65)\\ &\quad c[S_R-aS_L+(1-a)S_C]\angle\Phi_2\\ LR2' &= S_L+S_C- \quad (66)\\ &\quad b[S_R-aS_L+(1-a)S_C](\angle\Phi_1+\angle\Phi_2)-\\ &\quad c[S_R-aS_L+(1-a)S_C]\angle\Phi_2 \end{aligned}$$

Meanwhile, the output L3' of the second phase shifter 20L is sent without being inverted to the adder 24L through the delay circuit 21L and the attenuator 22L. In the adder 24L, the output L3 and the signal LR2' are added up. Denoting the output of the adder 24L by L4', the following equation is given.

$$\begin{aligned} L4' &= LR2'+d\cdot(L3'\angle\Phi_3) \quad (67)\\ &= S_L+S_C-\\ &\quad b[S_R-aS_L+(1-a)S_C](\angle\Phi_1+\angle\Phi_2)-\\ &\quad c[S_R-aS_L+(1-a)S_C]\angle\Phi_2+\\ &\quad db[S_L-aS_R+(1-a)S_C](\angle\Phi_1+\angle\Phi_2+\angle\Phi_3)+\\ &\quad dc[S_L-aS_R+(1-a)S_C](\angle\Phi_2+\angle\Phi_3) \end{aligned}$$

Similarly, denoting the output of the adder 24R by R4', the following equation is expressed.

$$\begin{aligned} R4' &= RL2'+d\cdot(R3'\angle\Phi_3) \quad (68)\\ &= S_R+S_C-\\ &\quad b[S_L-aS_R+(1-a)S_C](\angle\Phi_1+\angle\Phi_2)-\\ &\quad c[S_L-aS_R+(1-a)S_C]\angle\Phi_2+\\ &\quad db[S_R-aS_L+(1-a)S_C](\angle\Phi_1+\angle\Phi_2+\angle\Phi_3)+\\ &\quad dc[S_R-aS_L+(1-a)S_C](\angle\Phi_2+\angle\Phi_3) \end{aligned}$$

Here, the signals L4 (see equation (48)) and R4 (see equation (47)) in the parallel processing shown in FIG. 15 and the signals L4' (see equation (67)) and R4' (see equation (68)) in the sequential processing shown in FIG. 19 are compared.

Suppose that signals produced by extracting only $S_L$ components from the signals L4, R4, L4' and R4' are $(L4)_L$, $(R4)_L$, $(L4')_L$ and $(R4')_L$, respectively, $$(L4)_L = S_L + baS_L\angle\Phi_1 + caS_L\angle\Phi_2 + cdS_L(\angle\Phi_2 + \angle\Phi_3) \quad (69)$$

$$(R4)_L = -bS_L\angle\Phi_1 - cS_L\angle\Phi_2 - cdaS_L(\angle\Phi_2 + \angle\Phi_3) \quad (70)$$

$$(L4')_L = S_L + baS_L(\angle\Phi_1 + \angle\Phi_2) + caS_L\angle\Phi_2 + dbS_L(\angle\Phi_1 + \angle\Phi_2 + \angle\Phi_3) + dcS_L(\angle\Phi_2 + \angle\Phi_3) \quad (71)$$

$$(R4')_L = -bS_L(\angle\Phi_1 + \angle\Phi_2) - cS_L\angle\Phi_2 - dbaS_L(\angle\Phi_1 + \angle\Phi_2 + \angle\Phi_3) - dcaS_L(\angle\Phi_2 + \angle\Phi_3) \quad (72)$$

In equations (69) to (72), substantially the same characteristics as in the FIG. 15 are obtained by setting the attenuation coefficients b and c and the phases so that the synthetic waveform of the phase term of $(L4')_L$ approximates to the synthetic waveform of the phase term of $(L4)_L$ and that the synthetic waveform of the phase term of $(R4')_L$ approximates to the synthetic waveform of the phase term of $(R4)_L$.

As is clear from the equations, the sequential processing (the structure of FIG. 19) has a larger number of phase terms than the parallel processing (the structure of FIG. 15). Moreover, with the sequential processing, it is possible to increase the phase shift by $(\angle\Phi_1+\angle\Phi_2+\angle\Phi_3)$. It is thus possible to easily adjust the position of the virtual speaker in a wider range.

Additionally, unlike the parallel processing, in the sequential processing, there is no need to invert and add the output signals of the first phase shifters 16L and 16R. As a result, the number of steps in digital signal processing is reduced, thereby facilitating the addition of other functions. Suppose that signals produced by extracting only $S_C$ components from the signals L4' and R4' are $(L4')_C$, and $(R4')_C$, respectively, $$(L4')_C = S_C - b(1-a)S_C(\angle\Phi_1 + \angle\Phi_2) - c(1-a)S_C\angle\Phi_2 + db(1-a)S_C(\angle\Phi_1 + \angle\Phi_2 + \angle\Phi_3) + dc(1-a)S_C(\angle\Phi_2 + \angle\Phi_3) \quad (73)$$

$$(R4')_C = S_C - b(1-a)S_C(\angle\Phi_1 + \angle\Phi_2) - c(1-a)S_C\angle\Phi_2 + db(1-a)S_C(\angle\Phi_1 + \angle\Phi_2 + \angle\Phi_3) + dc(1-a)S_C(\angle\Phi_2 + \angle\Phi_3) \quad (74)$$

Namely, $(L4')_C=(R4')_C$. It is found that the signals obtained by extracting only the SC components are located in the center between the left and right speakers like in the parallel processing. Furthermore, when only $S_R$ components are extracted from the signals L4' and R4' in the same manner as the extraction of only the $S_L$ components, similar results are obtained. Therefore, a detailed explanation will be omitted here.

The following description discusses the relationship between the position of the listener and the positions of the speakers.

As illustrated in FIG. 3, the relationship between the position of the listener and the positions of the speakers is based on the placement of the listener positioned with the speakers 10L and 10R on lines directed laterally outwardly and forwardly at 30° on either side of the listener. When the distance between the listener and the speaker 10L and the distance between the listener and the speaker 10R are equal to each other, the virtual speakers 10L' and 10R' are most effectively positioned at the back of the listener. The reason for this is that since a sound synthesized at the position of the listener by signals of different phases from the speakers 10L and 10R is processed to simulate the virtual speakers, if the distance between the listener and the speaker 10L and the distance between the listener and the speaker 10R are not equal to each other, the phase difference is varied. Consequently, the virtual speakers can hardly be simulated.

As for the realization of a speaker angle of 30°, there is a limitation in changing the position of the listener in the left and right directions and the forward and backward directions. More specifically, the listener is movable from the center line between the left and right speakers 10L and 10R to the left and right, respectively, by substantially 20 cm to 30 cm which is equivalent to the heads of two people. With respect to the limitation in the forward and backward directions of the listener, the listener is movable by a distance around a maximum of 5 m and a minimum of 30 cm from the front faces of the speakers 10L and 10R although the value varies depending on the condition of the listening room and the volume of the speakers. The speaker angle is varied in a range of from a minimum of around 5° to a maximum of around 60° by adjusting the second phase shifter 20L and the attenuator 18L (the second phase shifter 20R and the attenuator 18R) (see FIG. 20).

Figure 20:
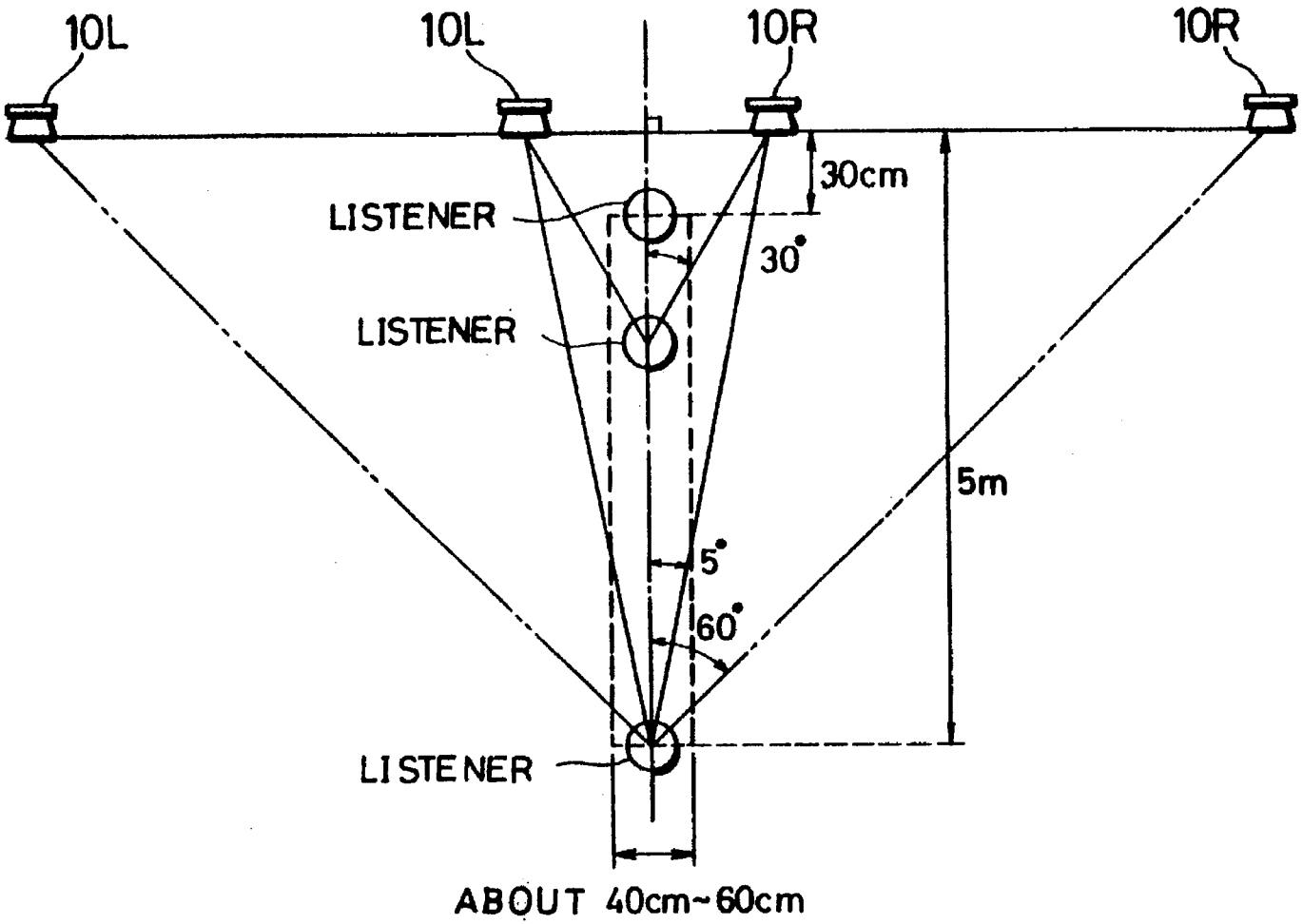
FIG. 20 is an explanatory view showing an area within which the listener is movable in forward, backward, left and right directions, and angles of speakers.

The above-mentioned structure is illustrated in FIG. 20. The angles of the left and right speakers are registered at 30°, respectively. When the speaker angle is fixed at 30°, the limitation in positioning a virtual speaker at the back of the listener is equivalent to the limitation in the case where the position of the listener is moved substantially by 20 percent of the distance from the front faces of the speakers 10L and 10R to the listener in a forward or backward direction. On the other hand, when the speaker angle is not fixed, a user registers the position of the listener, and the amount of shift of the second phase shifter 20L and the attenuation coefficient of the attenuator 13R (the amount of shift of the second phase shifter 20R and the attenuation coefficient of attenuator 13L) are set depending on the registered position, thereby simulating virtual speakers at the back of the listener.

Namely, the virtual speakers are simulated at the back of the listener by decreasing the amount of shift of the second phase shifter when the speaker angle is increased and by increasing the amount of shift when the speaker angle is decreased. However, if the speaker angle is decreased to near 5°, the increased crosstalk occurs when sounds from the left and right speakers 10L and 10R reach the ears of the listener. As a result, the sound image at the back of the listener is likely to be lost, and widening of sounds, particularly, mid and high frequency band sounds, is impaired.

Next, a process of registering the position of the listener will be explained. First, the speaker angles with the range of from 10° to 60° are equally divided, and matched with pre-registered amounts of shift and attenuation. The listener position is easily registered by inputting numerical values corresponding to desired amounts or selecting the desired amounts using setting means.

Figure 21:
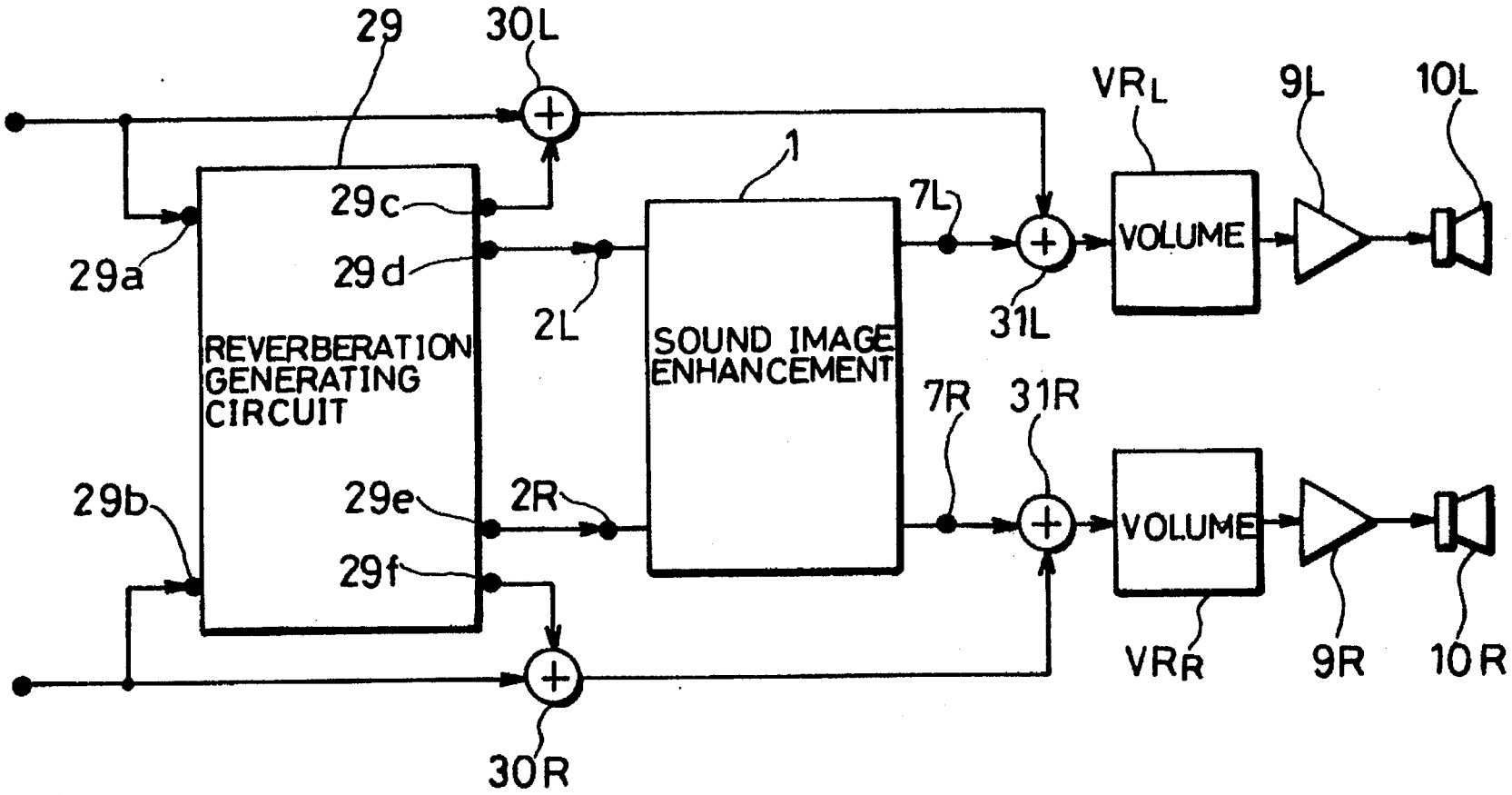
FIG. 21 is a block diagram showing an example in which a reverberation sound signal generating circuit is provided in the front stage of the sound image enhancement apparatus.
Figure 22:
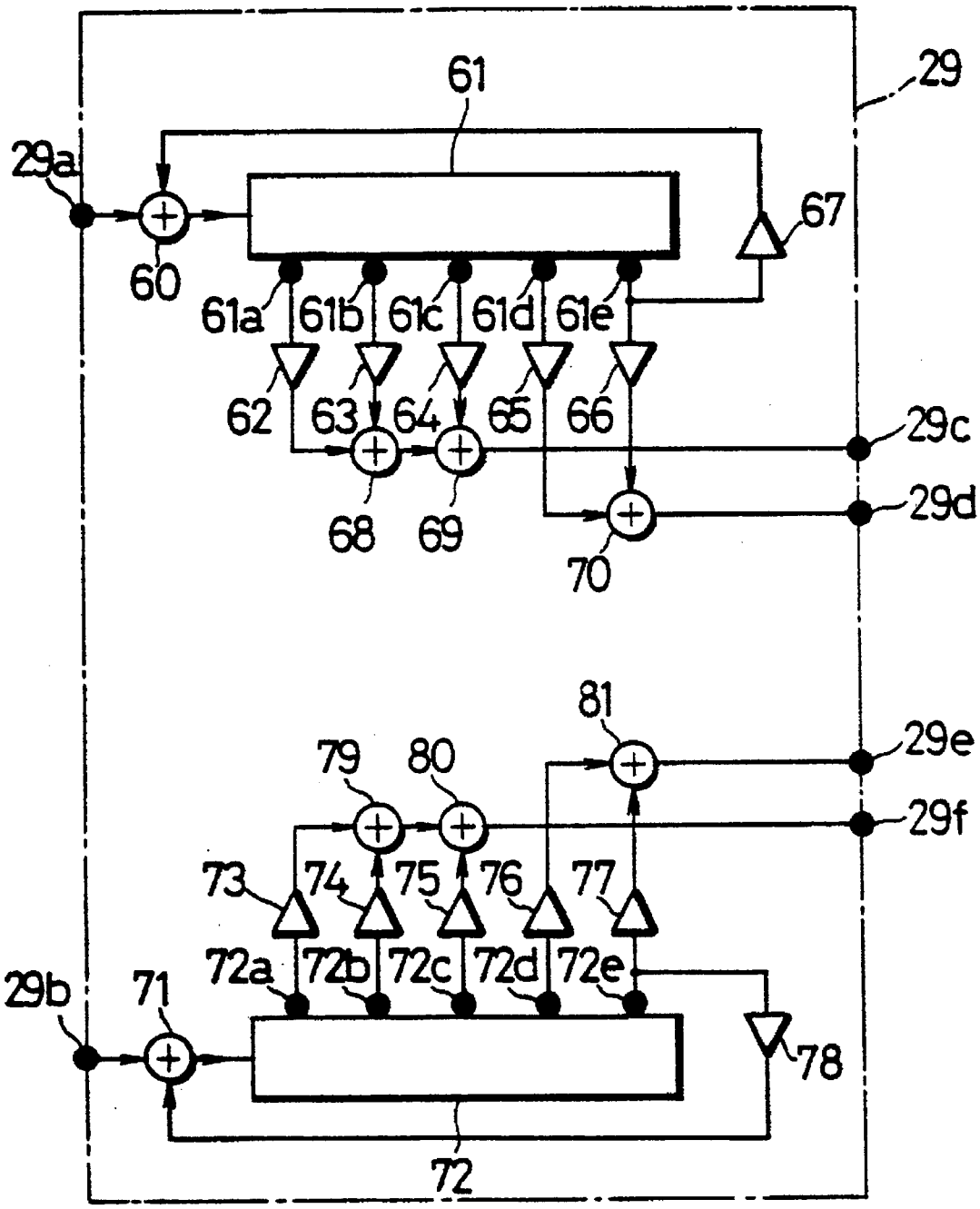
FIG. 22 is an explanatory view showing a specific example of the reverberation sound signal generating circuit.
Figure 23:
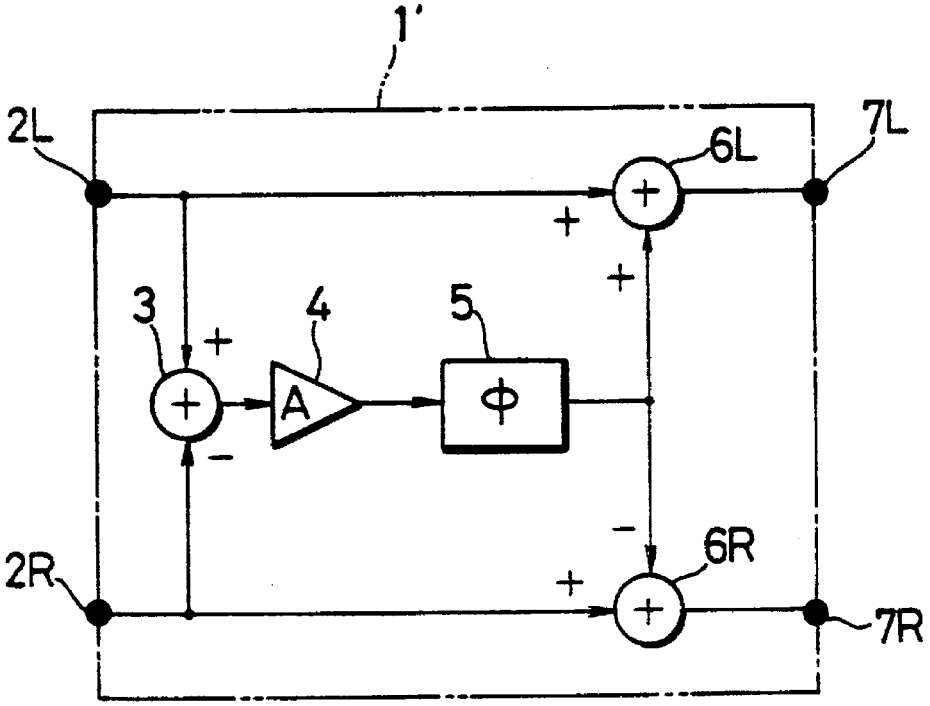
FIG. 23 is a block diagram showing the structure of essential sections of a conventional sound image enhancement circuit.
Figure 24:
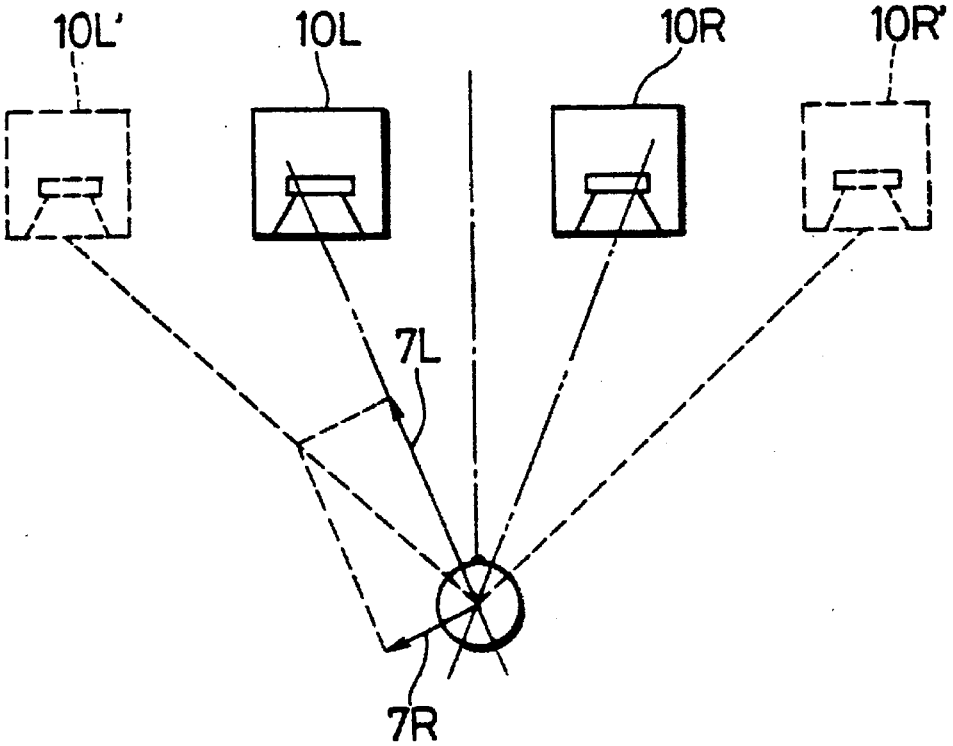
FIG. 24 is an explanatory view showing a relationship between speakers and virtual speakers of the conventional example.
Figure 25:
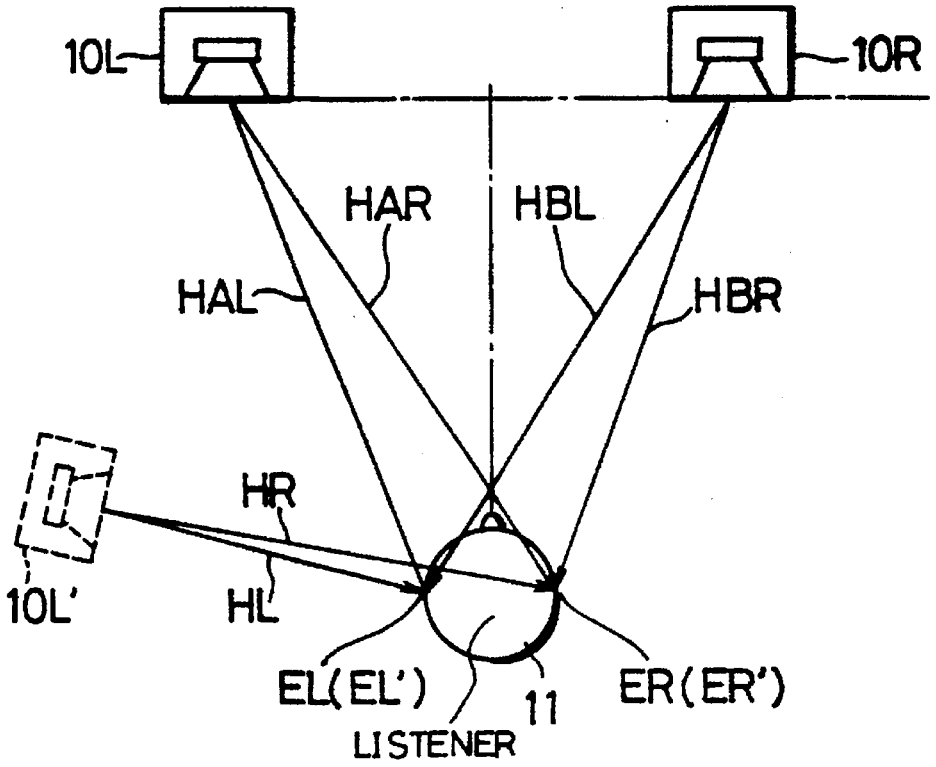
FIG. 25 is an explanatory view showing a conventional example of sound image enhancement based on a transfer function.
Figure 26:
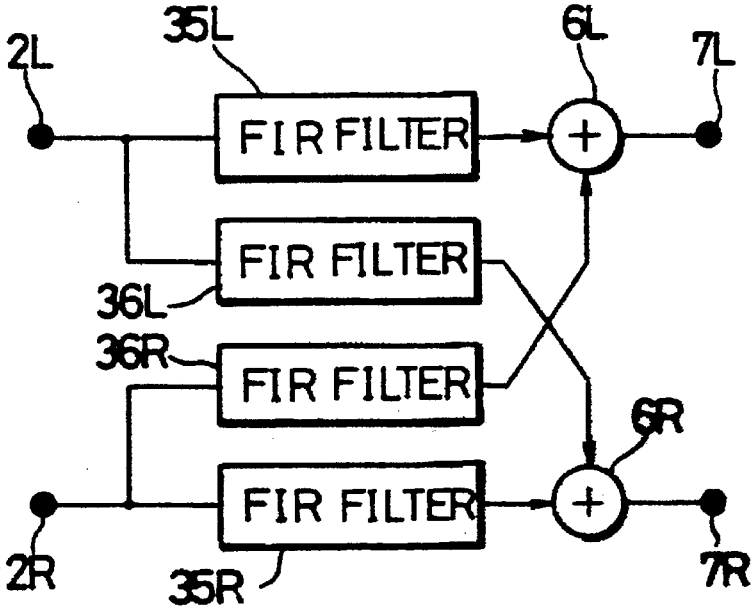
FIG. 26 is an explanatory view showing an example in which a conventional sound image enhancement circuit is formed by an FIR filter.

Referring now to FIGS. 21 and 22, the following description will discuss an example of simulating the perception of a sound field at a live performance by reproducing reverberation sounds from the front, back and sides using only two front speakers by suitably mixing two-channel reverberation signals. The sound image enhancement apparatus 1 shown in FIG. 21 may have any one of the structures of the above-mentioned sound enhancement apparatuses.

According to this embodiment, as illustrated in FIG. 21, a reverberation sound signal generating circuit 29 (reverberation sound signal generating means) is provided at a front stage of the sound enhancement apparatus 1. For example, the reverberation sound signal generating circuit 29 has the structure shown in FIG. 22. In this structure, the left channel series includes a delay memory group 61, a plurality of attenuators 62 to 67, and a plurality of adders 60, 68, 69 and 70, while the right channel series includes a delay memory group 72, a plurality of attenuators 73 to 78, and a plurality of adders 71, 79, 80 and 81.

A stereo signal L (R) from the sound source 8 is input through an input terminal 29*a* (29*b*) to the adder 60 (71). In the adder 60 (71), the stereo signal L (stereo signal R) and an output of attenuator 67 (78) are added up, and sent to the delay memory group 61 (72).

For example, the delay memory group 61 (72) includes a first memory 61*a* (72*a*) to a fifth memory 61*e* (72*e*). The input sum signal is first stored in the first memory 61*a* (72*a*). A desired delay time is obtained by setting an address of the first memory 61*a* (72*a*) after the elapse of the desired time and reading out the stored signal. Addresses allocated for the second memory 61*b* (72*b*) to the fifth memory 61*e* (72*e*) are different from each other. Therefore, desired delay times are obtained by reading out the sum signal at a desired time point, which was stored by setting the respective addresses after the elapse of the desired times.

An output of the fifth memory 61*e* (72*e*) is attenuated by a predetermined attenuation coefficient of the attenuator 67 (78), sent to the adder 60 (71), and added to the stereo signal L (stereo signal R). When the output of the fifth memory 61*e* (72*e*) is fed back to the first memory 61*a* (72*a*), reverberation sound signals are continuously produced.

The signal read from the first memory 61*a* (72*a*) is input to the attenuator 62 (73), attenuated by a predetermined attenuation coefficient, and sent to the adder 68 (79). The signal read from the second memory 61*b* (72*b*) is input to the attenuator 63 (74), attenuated by a predetermined attenuation coefficient, and sent to the adder 68 (79).

In the adder 68 (79), the outputs of the attenuators 62 and 63 (73 and 74) are added up, and sent to the adder 69 (80). In the adder 69 (80), the output of the adder 68 (79) and the signal which was read from the third memory 61*c* (72*c*) and attenuated by a predetermined attenuation coefficient are added up, and sent as a first reverberation sound signal from the output terminal 29*c* (29*f*) to the adder 30L (30R) as six summing means.

In the adder 30L (30R), the stereo signal L (stereo signal R) and the first reverberation sound signal are added up, the resulting signal is added to a sound image enhanced signal from the output terminal 7L (7R) in the left channel (right channel) of the sound image enhancement apparatus 1, and sent to the volume controller $VR_L$ ($VR_R$). The first reverberation sound signal is used as a reflected sound from the front.

On the other hand, signals read out from the fourth memory 61*d* (72*d*) and the fifth memory 61*e* (72*e*) are attenuated by predetermined attenuation coefficients in the attenuator 65 (76) and the attenuator 66 (77), respectively, added up in the adder 70 (81), and sent as a second reverberation sound signal from the output terminal 29*d* (29*e*) to the input terminal 2L (2R) of the left channel (right channel) of the sound image enhancement apparatus 1 where sound image enhancement processing is performed. The second reverberation sound signal is used as a reflected sound from the back.

The output of the adder 30L (30R) is sent to the adder 31L (31R) as seventh summing means, and added to an output signal to which sound image enhancement processing has been applied based on the second reverberation sound signal by the sound image enhancement apparatus 1. The output of the adder 31L (31R) is sent to the speaker 10L (10R) through the volume controller $VR_L$ ($VR_R$) and the amplifier 9L (9R).

In this embodiment, the left channel series is explained. The right channel series will also be explained in the same way, and numerals indicated in brackets correspond to the right channel series.

With the above-mentioned structure, the sum signal of the first reverberation sound signal and the stereo signal L becomes a reverberation sound reproduced by the front speaker 10L. The second reverberation sound signal to which sound image enhancement processing was applied becomes a reverberation sound reproduced by a virtual rear left speaker.

Similarly, the sum signal of the first reverberation sound signal and the stereo signal R becomes a reverberation sound reproduced by the front speaker 10R. The second reverberation sound signal to which sound image enhancement processing was applied becomes a reverberation sound reproduced by a virtual rear right speaker.

Consequently, a far improved sound field simulating the perception of a live performance is obtained compared with that produced by a prior art which adds reverberation sounds using two front speakers. Additionally, effects similar to the reproduction of reverberation sounds with rear speakers are produced. Furthermore, the perception of a live performance is easily simulated with a reduced number of time consuming works such as wiring compared with the use of four speakers.

It is necessary to arrange the delay of the first reverberation sound signal to be smaller than the delay of the second reverberation sound signal. With this arrangement, a signal delayed by a larger amount is reproduced from the rear virtual speakers, thereby achieving more natural sound field. The number of attenuators (the number of delays) for obtaining the first reverberation sound signal is not particularly limited to the above mentioned number, three.

Moreover, the number of attenuators (the number of delays) for obtaining the second reverberation sound signal is not particularly limited to the above mentioned number, two. Namely, if the amounts of delay of the first and second reverberation sound signals satisfy the above-mentioned relationship, the number of attenuators is freely changed. Additionally, in the above-mentioned embodiments, the left channel or the right channel is explained as an independent delay memory group. However, it is possible to obtain the first and second reverberation sound signals by, for example, mixing the stereo signals L and R in both the channels. It is also possible to use a delay output of the left channel as a reverberation sound signal of the right channel. Namely, structures for obtaining the first and second reverberation sound signals are suitably selected depending on a desired sound field.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sound image enhancement apparatus for reproducing two-channel stereo signals with speakers, comprising for each channel:

additional signal generating means for subtracting from a stereo input signal in one of the two channels a stereo input signal in the other channel which has been attenuated by a first attenuation coefficient, and outputting the resulting signal as an additional signal;

first phase shifting means for attenuating the additional signal by a second attenuation coefficient, and introducing a predetermined phase shift into the attenuated signal;

second phase shifting means for attenuating the additional signal by a third attenuation coefficient, correcting a frequency characteristic thereof, and introducing a predetermined phase shift into the resulting signal;

first summing means for inverting a phase of an output of said first phase shifting means, and adding the inverted output to the stereo input signal in the other channel; and second summing means for inverting a phase of an output of said second phase shifting means, adding the inverted output to an output of said first summing means, and sending the resulting sum to the speaker in the other channel.

2. The sound image enhancement apparatus according to claim 1, wherein said first phase shifting means includes:

(1) a plurality of band-pass means, provided for each of predetermined frequency bands, for transmitting only input signals within the predetermined frequency bands;

(2) delaying means for introducing a predetermined phase delay into an output of each of said band-pass means; and (3) fourth summing means for adding up outputs of said delaying means, and wherein said second phase shifting means includes an IIR-type digital low-pass filter.

3. The sound image enhancement apparatus according to claim 1, wherein said first phase shifting means includes:

a plurality of band-pass filters for dividing input signals according to predetermined frequency bands; and a delay circuit for delaying outputs of said band-pass filters to introduce phase shifts.

* * * * *